US006946994B2

(12) United States Patent
Imaizumi et al.

(10) Patent No.: US 6,946,994 B2
(45) Date of Patent: Sep. 20, 2005

(54) DIELECTRIC ANTENNA

(75) Inventors: Tatsuya Imaizumi, Tokyo (JP); Hironori Okado, Tokyo (JP); Hisahiro Yasuda, Tokyo (JP); Naoto Kobayashi, Tokyo (JP); Takashi Amano, Tokyo (JP); Kazuya Maekawa, Tokyo (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 222 days.

(21) Appl. No.: 10/433,045

(22) PCT Filed: Apr. 15, 2002

(86) PCT No.: PCT/JP02/03725

§ 371 (c)(1),
(2), (4) Date: May 30, 2003

(87) PCT Pub. No.: WO03/034539

PCT Pub. Date: Apr. 24, 2003

(65) Prior Publication Data

US 2005/0078034 A1 Apr. 14, 2005

(30) Foreign Application Priority Data

Oct. 11, 2001 (JP) ..... 2001-313847

(51) Int. Cl.[7] ..... H01Q 1/38; H01Q 1/24

(52) U.S. Cl. ..... 343/700 MS; 343/702; 343/895

(58) Field of Search ..... 343/700 MS, 702, 343/846, 873, 895; H01Q 1/38, 1/24

(56) References Cited

U.S. PATENT DOCUMENTS 5,870,066 A * 2/1999 Asakura et al. ..... 343/895
6,075,491 A * 6/2000 Dakeya et al. ..... 343/722
6,388,626 B1 * 5/2002 Gamalielsson et al. ..... 343/702
6,459,413 B1 * 10/2002 Tseng et al. ..... 343/702
6,680,701 B2 * 1/2004 Sung ..... 343/700 MS
2001/0043161 A1 * 11/2001 Tseng et al. ..... 343/895

FOREIGN PATENT DOCUMENTS

| | | | |
|---|---|---|---|
| EP | 764999 | A1 | 3/1997 |
| JP | 10-200318 | A | 7/1998 |
| JP | 11-205025 | A | 7/1999 |
| JP | 11-214914 | A | 8/1999 |
| JP | 11-330842 | A | 11/1999 |
| JP | 2001-68917 | A | 3/2001 |
| JP | 2001-144524 | A | 5/2001 |
| JP | 2001-217632 | A | 8/2001 |
| JP | 2002-100915 | A | 4/2002 |

* cited by examiner

*Primary Examiner*—Hoanganh Le
(74) *Attorney, Agent, or Firm*—Lowe, Hauptman & Berner, LLP

(57) ABSTRACT

The present invention relates mainly to a small dielectric antenna capable of obtaining a good VSWR characteristic even if it is placed in the vicinity of a grounding pattern when mounted on a circuit board. A dielectric antenna is formed in which a feed point of an antenna element 13 having a resonance frequency set to a first frequency in a first frequency band and a feed point of an antenna element 14 having a resonance frequency set to a second frequency are connected to an external feed terminal 12*b*, and an open stub 15 connected to the antenna element 14 in the vicinity of the feed point. The open stub 15 is provided to enable resonance at each of frequencies to be used while the lengths of the antenna elements 13 and 14 are shorter than ordinary lengths determined according to the wavelengths of the frequency to be used. Further, even in the case of placement in the vicinity of a grounding conductor pattern 3 at the time of mounting on a circuit board 1, the frequency bandwidth through which a good VSWR characteristic can be obtained in a used frequency band can be extended.

18 Claims, 25 Drawing Sheets

COMPARATIBE EXAMPLE

COMPARATIBE EXAMPLE

COMPARATIBE EXAMPLE

DIELECTRIC ANTENNA

TECHNICAL FIELD

The present invention relates to a dielectric antenna used in a cellular phone or a portable wireless communication device and, more particularly, to a dielectric antenna that allows for increased packaging density on a circuit board.

BACKGROUND ART

In recent years, with the widespread proliferation of cellular phones and portable wireless communication devices, there has been an increased demand for reducing the size and weight of them. The miniaturization of various electronic components including semiconductor integrated circuits has been rapidly advanced. However, the antenna is a hindrance to miniaturization of wireless communication devices. As is well known, the antenna is an entrance and exit for electromagnetic waves and the efficiency of the antenna is extremely low if the antenna is not resonant with a used frequency. In the case of an ordinary dipole antenna, the necessary length is ½ wavelength of a used frequency and it is, therefore, very difficult to reduce the size. Various devices relating to miniaturization of antennas have therefore been proposed.

For example, an antenna disclosed in Japanese Patent Laid-Open No. 10-13135 is formed so as to be smaller in size and capable of resonating in two frequency bands by having an antenna element folded back so as to be substantially parallel along the longitudinal direction.

Also, an antenna disclosed in Japanese Patent Laid-Open No. 10-229304 is devised in such a manner that an antenna element is formed on a surface of a dielectric substrate to enable the antenna to be further reduced in size and to be used by being mounted on a circuit board in a simple manner.

However, with the advancement of the miniaturization and integration of cellular phones and portable wireless communication devices, a need arises for placement in the vicinity of a grounding conductor pattern formed on a circuit board at the time of mounting on the circuit board. In such a case, there is a problem that if a conventional antenna is placed in the vicinity of the grounding conductor pattern, the resonance frequency of the antenna is changed so that the VSWR in a frequency band used for communication is increased and the efficiency is considerably reduced.

For example, in the case of a 2.4 GHz dielectric antenna in the form of a rectangular block, if it is necessary to place the dielectric antenna in the vicinity of a grounding conductor due to the above-described advancement of the miniaturization and integration, a voltage standing wave ratio (hereinafter referred to as VSWR) required to enable use of the antenna cannot be obtained unless the distance between the dielectric antenna and the grounding conductor is increased to a value equal to or larger than 3 mm.

On the other hand, while internet connection (dial up connection) through a cellular phone connected to a notebook-type personal computer away from home has been used, internet connection using a kind of wireless communication is now attracting attention. This is a service generally called "hot spot", i.e., a system in which a wireless LAN base station is installed in a certain building and internet connection is established therethrough. Frequencies in the 2.4 GHz and 5.2 GHz bands are used for this wireless LAN.

Therefore there is a need to provide an antenna capable of communication in two frequency bands in a case where a wireless communication device for use with a wireless LAN capable of communication in the two frequency bands is configured. Thus, there is a hindrance to miniaturization of wireless communication devices.

In view of the above-described problem, an object of the present invention is to provide a small dielectric antenna capable of obtaining a good VSWR characteristic in frequency bands to be used even if the antenna is placed in the vicinity of a grounding conductor pattern when mounted on a circuit board. Another object of the present invention is to provide a small dielectric antenna having a good VSWR characteristic in two different frequency bands.

DISCLOSURE OF THE INVENTION

To achieve the above-described objects, according to the present invention, there is proposed a dielectric antenna constituted by a laminated member having conductors provided on its surface, and which is formed of at least one dielectric layer, and at least one external terminal provided on the external surface of the laminated member, the dielectric antenna having a first antenna element formed by conductors formed on the laminated member and having a resonance frequency set to a first frequency in a first frequency band, a second antenna element formed by conductors formed on the laminated member and having a resonance frequency set to a second frequency different from the first frequency in the first frequency band, an external terminal for feed connected to a feed point of the first antenna element and to a feed point of the second antenna element, and an open stub connected to the second antenna element.

The dielectric antenna of the present invention is provided with the open stub and is therefore capable of resonating at each of frequencies to be used even when the length of each of the first and second antenna elements is shorter than the ordinary length determined according to the frequency to be used. Also, the open stub is connected to one of the conductors in the second antenna element connected to the external feed terminal and is formed along the lengthwise direction of the laminated member. Therefore the open stub can be placed in a region of a dielectric layer surface where no conductor is formed. Therefore the size of the dielectric antenna itself is not increased even though the open stub is formed, thus enabling miniaturization. Further, even in the case of placement in the vicinity of a grounding conductor pattern at the time of mounting on a circuit board, the frequency bandwidth through which a good VSWR characteristic can be obtained in a used frequency band can be extended.

Also, in the dielectric antenna of the present invention, the first antenna element and the second antenna element are provided on different layers with the dielectric layer interposed therebetween to enable the laminated member to be formed so as to smaller in size, and the open stub is placed so as to overlap part of the first antenna element with the dielectric layer interposed therebetween to provide capacitive coupling between the first antenna element and the open stub and to connect an inductance component of the open stub in parallel with part of the first antenna element, thereby further reducing the length of the first antenna element.

Further, the first antenna element is formed by being folded so as to meander in a lamination surface to set a plurality of positions at which portions of the first antenna element and the open stub are superposed.

Also, an end portion of at least one of the first antenna element and the second antenna element has two or more branches to produce an electrostatic capacity between the end portion conductor and a grounding conductor near the conductor. By this electrostatic capacity, the antenna element forms a head capacity type of antenna. In this manner, the length of the antenna element resonating at the first or second frequency is reduced.

Also, an end portion of at least one of the first antenna element and the second antenna element is larger in width than the inner conductor adjacent to the end portion to produce an electrostatic capacity between the end portion conductor and a grounding conductor near the conductor. By this electrostatic capacity, the antenna element forms a head capacity type of antenna. In this manner, the length of the antenna element resonating at the first or second frequency is reduced.

A conductor having its one end connected to the first antenna element at a predetermined position on the feed point side and another end connected to the external terminal for grounding is also provided to form the first antenna element as an antenna generally called an inverted F-type antenna.

Further, according to the present invention, the first frequency is set higher than the second frequency.

Also, the meander spacing of the first antenna element is such that the voltage standing wave ratio at a frequency in a second frequency band different from the first frequency band is lower than a predetermined value, thereby enabling use in each of the first frequency band and the second frequency band.

BEST MODE FOR CARRYING OUT THE INVENTION

An embodiment of the present invention will be described with reference to the drawings.

Figure 1:
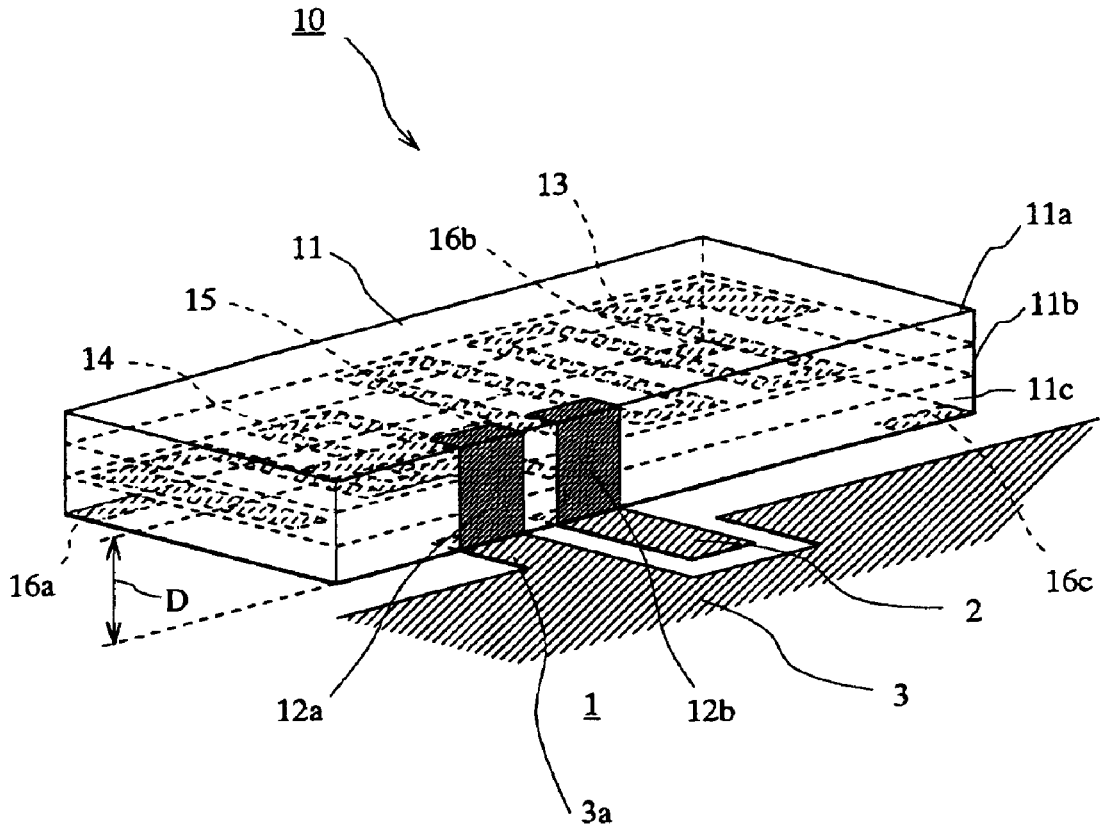
FIG. 1 is a see-through oblique perspective figure of a dielectric antenna in a first embodiment of the present invention.
Figure 2:
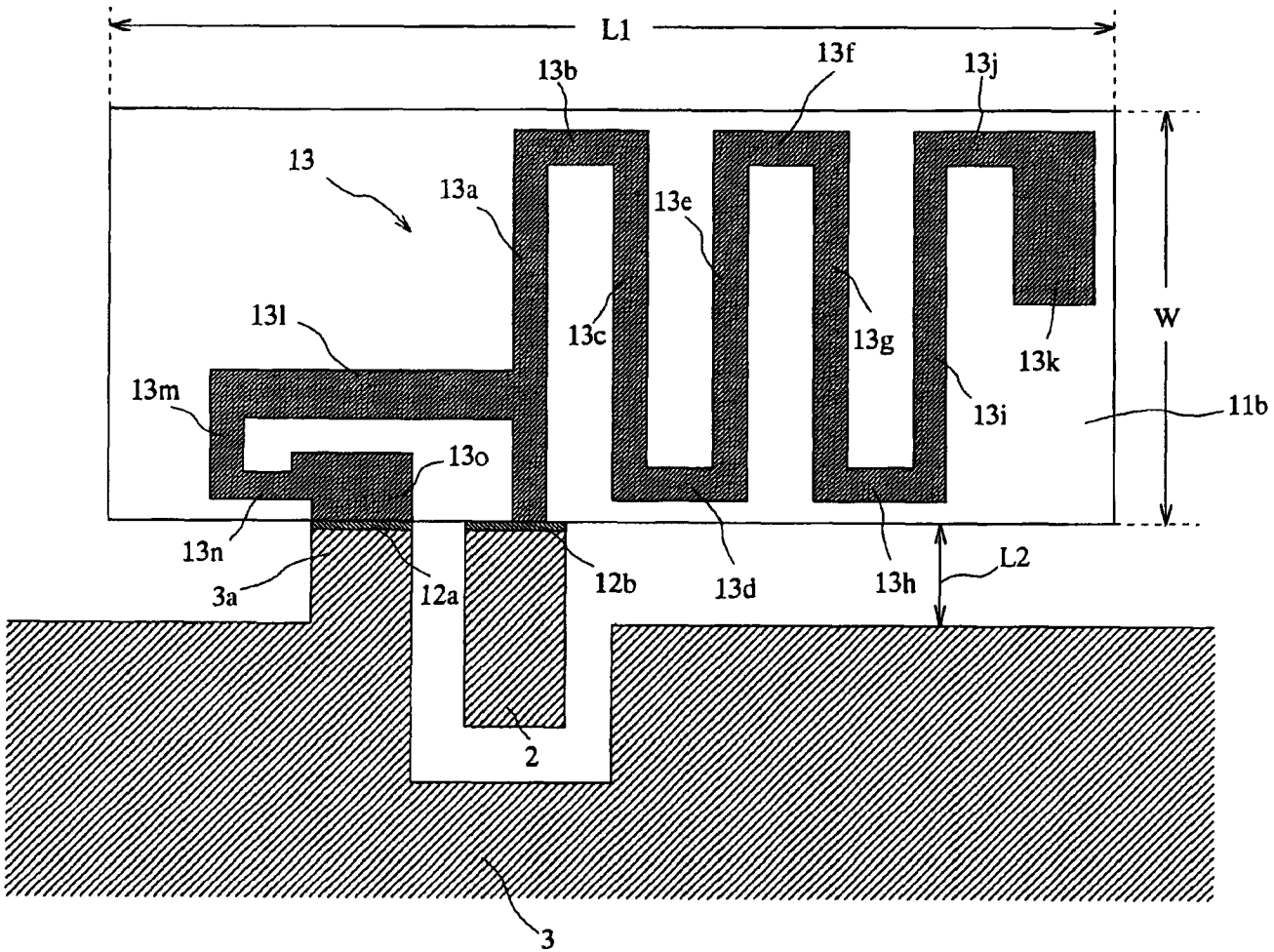
FIG. 2 is a plan view of a first antenna element in the first embodiment of the present invention.
Figure 3:
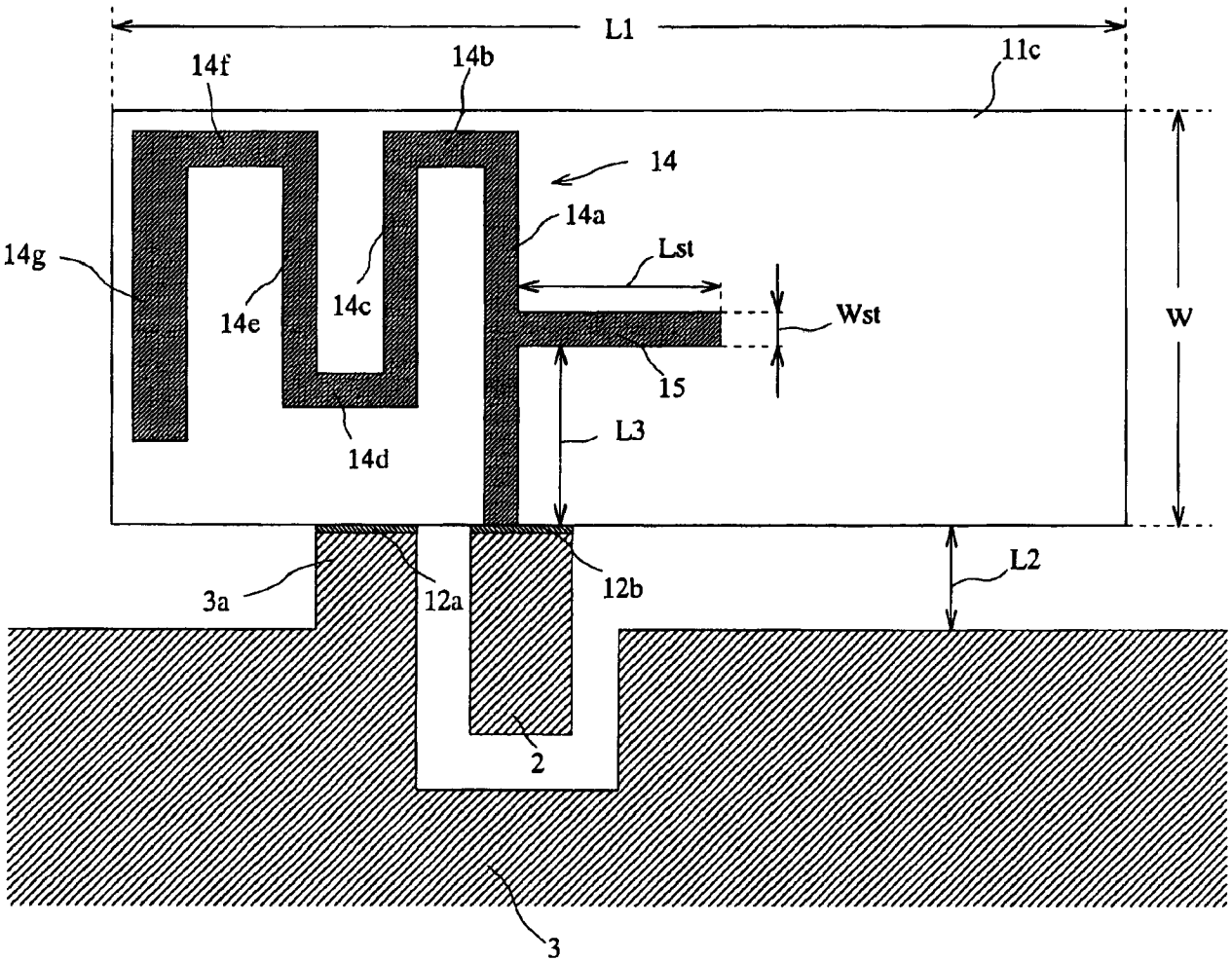
FIG. 3 is a plan view of a second antenna element in the first embodiment of the present invention.

FIG. 1 is a perspective see-through view of a dielectric antenna in a first embodiment of the present invention, FIG. 2 is a plan view of a first antenna element, and FIG. 3 is a plan view of a second antenna element. An example of a 2.4 GHz band dielectric antenna presently used for mobile communication will be described as the first embodiment.

Referring to FIGS. 1 to 3, a dielectric antenna 10 has a laminated member 11 laminated from flat substrates 11*a*, 11*b*, and 11*c* (hereinafter referred to simply as "substrate") having an insulating property and made of a dielectric ceramic material. External terminals 12*a* and 12*b* are provided on one side surface of the laminated member 11.

Conductors which form the first antenna element (hereinafter referred to simply as "antenna element") 13 are provided on an upper surface of the intermediate layer substrate 11*b*. Also, conductors which form the second antenna element (hereinafter referred to simply as "antenna element") 14 are provided on an upper surface of the lower layer substrate 11*c*. Further, a plurality of dummy electrodes 16*a* to 16*c* are formed on a back surface of the lower layer substrate 11*c* to enable stable soldering fixation at the time of mounting on a circuit board 1.

The laminated member 11 has as its dimensions a length L1 of 10 mm, a width W of 4 mm, and a thickness D of 1 mm. In FIGS. 2 and 3, the sizes of portions are shown in the same proportion as the actual size proportions.

The antenna element 13 formed on the upper surface of the substrate 11*b* is formed of conductor strips 13*a* to 13*o*. The antenna element 13 is an element generally called an inverted F-type antenna. The antenna element 13 meanders with a predetermined meander spacing (meander pitch) and is placed in the form of a rectangular wave. The resonance frequency of the antenna element 13 is set to, for example, 2.4 GHz and the feed point impedance of the antenna element 13 is set to, for example, about 100 Ω. One end of the conductor 13*a* is connected to the external terminal 12*b*, which is a feed point. The conductors 13*b* to 13*k* are connected to the other end of the conductor 13*a* by being connected in the described order while being folded so as to meander. The spacings between the adjacent pairs of the conductors 13*a*, 13*c*, 13*e*, 13*g*, and 13*i*, i.e., the spacing between the conductor 13*a* and the conductor 13*c*, the spacing between the conductor 13*c* and the conductor 13*e*, the spacing between the conductor 13*e* and the conductor 13*g*, and the spacing between the conductor 13*g* and the conductor 13*i*, are set approximately equal to each other.

The conductor 13*k* in an end portion of the antenna element 13 is formed so as to be larger in width than the conductor 13*j* adjacent to the end portion. The area of the end portion is increased in this manner to produce an electrostatic capacity between the conductor 13*k* and a grounding conductor located near the conductor 13*k*. By this electrostatic capacity, the antenna element 13 forms a head capacity type of antenna. The length of the antenna element 13 resonating at 2.4 GHz is thereby reduced.

Also, conductors 13*l* to 13*o* are provided on the side of the conductor 13*a* opposite from the side on which the conductors 13*b* to 13*k* are placed. One end of the conductor 13*l* is perpendicularly connected to a portion of the conductor 13*a* at an intermediate position in the lengthwise direction. Further, one end of the conductor 13*m* is perpendicularly connected to the other end of the conductor 13*l*. One end of the conductor 13*n* is perpendicularly connected to the other end of the conductor 13*m*. The other end of the conductor 13*n* is connected through the conductor 13*o* to the external terminal 12*a*, which is a grounding terminal.

The antenna element 14 formed on the upper surface of the substrate 11*c* is formed of conductor strips 14*a* to 14*g*. The resonance frequency of the antenna element 14 is set to, for example, 2.5 GHz and the feed point impedance of the antenna element 14 is set to, for example, about 100 Ω. One end of the conductor 14*a* is connected to the external terminal 12*b*, which is a feed point, and the conductors 14*b* to 14*g* are connected to the other end of the conductor 14*a* by being connected in the described order while being folded so as to meander. Thus, the antenna element 14 is formed into the shape of a rectangular wave. These conductors 14*b* to 14*g* are placed so as to overlap the conductors 13*l* to 13*o* constituting the above-described antenna element 13, with the substrate 11*b* (dielectric layer) interposed therebetween.

Further, the conductor 14*g* in an end portion of the antenna element 14 is formed so as to be larger in width than the conductor 14*f* adjacent to the end portion. The area of the conductor 14*g* is increased in this manner to produce an electrostatic capacity between the conductor 14*g* and the grounding conductor located near the conductor 14*g*. By this electrostatic capacity, the antenna element 14 forms a head capacity type of antenna. The length of the antenna element 14 resonating at 2.5 GHz is thereby reduced.

Also, an open stub 15 formed of a rectangular conductor is provided on the opposite side of the conductor 14*a*. One end of the open stub 15 is perpendicularly connected to a portion of the conductor 14*a* at an intermediate position in the lengthwise direction. The open stub 15 is formed along the lengthwise direction of the laminated member 11. The open stub 15 has its length Lst set to about 2 mm and its width Wst set to 0.3 mm. Further, the distance L3 between the position at which the open stub 15 and the conductor 14*a* are connected and the feed point (external terminal 12*b*) is set to about 2 mm. Also, the open stub 15 is placed so as to be capacitive-coupled to the antenna element 13 at a plurality of positions with the substrate 11*b* interposed therebetween.

When the dielectric antenna 10 is used, it is mounted on the circuit board 1 with the external terminal 12*a* for grounding connected to a connection land 3*a* of a grounding conductor 3 formed on the circuit board 1, and with the external terminal 12*b* for feed connected to a feed land 2 formed on the circuit board 1.

In the dielectric antenna 10 constructed as described above, the open stub 15 is provided to enable the distance L2 from the grounding conductor 3 formed on the circuit board 1 to be reduced in comparison with that in the conventional arrangement when the dielectric antenna 10 is mounted on the circuit board 1. The dielectric antenna 10 of this embodiment was obtained with a good characteristic while the distance L2 from the grounding conductor 3 was set to 1 mm. Also, it was formed so as to be smaller in size than the conventional ones.

Figure 4:
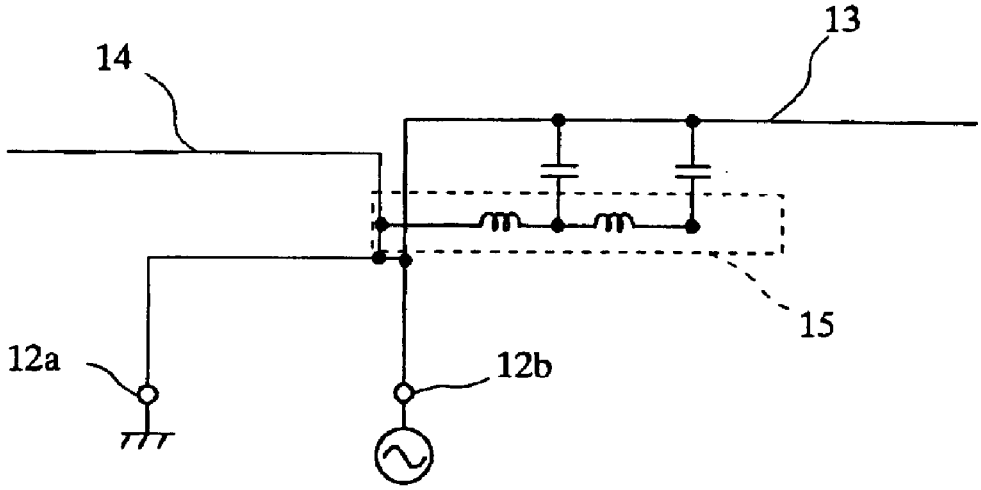
FIG. 4 is a diagram for explaining the function of an open stub in the first embodiment of the present invention.

That is, in the dielectric antenna 10, since the feed points of the two antenna elements 13 and 14 are connected to the common external terminal 12*b* as shown in FIG. 4, the feed point impedance at the external terminal 12*b* is 50 Ω, the same value as the high-frequency input/output impedance ordinary set in high-frequency transmitting/receiving circuits.

Further, in the dielectric antenna 10, since the open stub 15 is placed so as to be capacitive-coupled to the antenna element 13 at a plurality of positions with the substrate 11*b* interposed therebetween, capacitive coupling is provided between the antenna element 13 and the open stub 15 while an inductance component of the open stub 15 is connected in parallel with part of the antenna element 13, as shown in FIG. 4, thereby further reducing the length of the antenna element 13.

Also, as described above, an electrostatic capacity is produced between the conductor 13*k* or 14*g* in the end portion of the antenna element 13 or 14 and the grounding conductor near the conductor, and each of the antenna elements 13 and 14 forms a head-capacity antenna by the electrostatic capacity, so that the length of each of the antenna elements 13 and 14 is further reduced.

Figure 5:
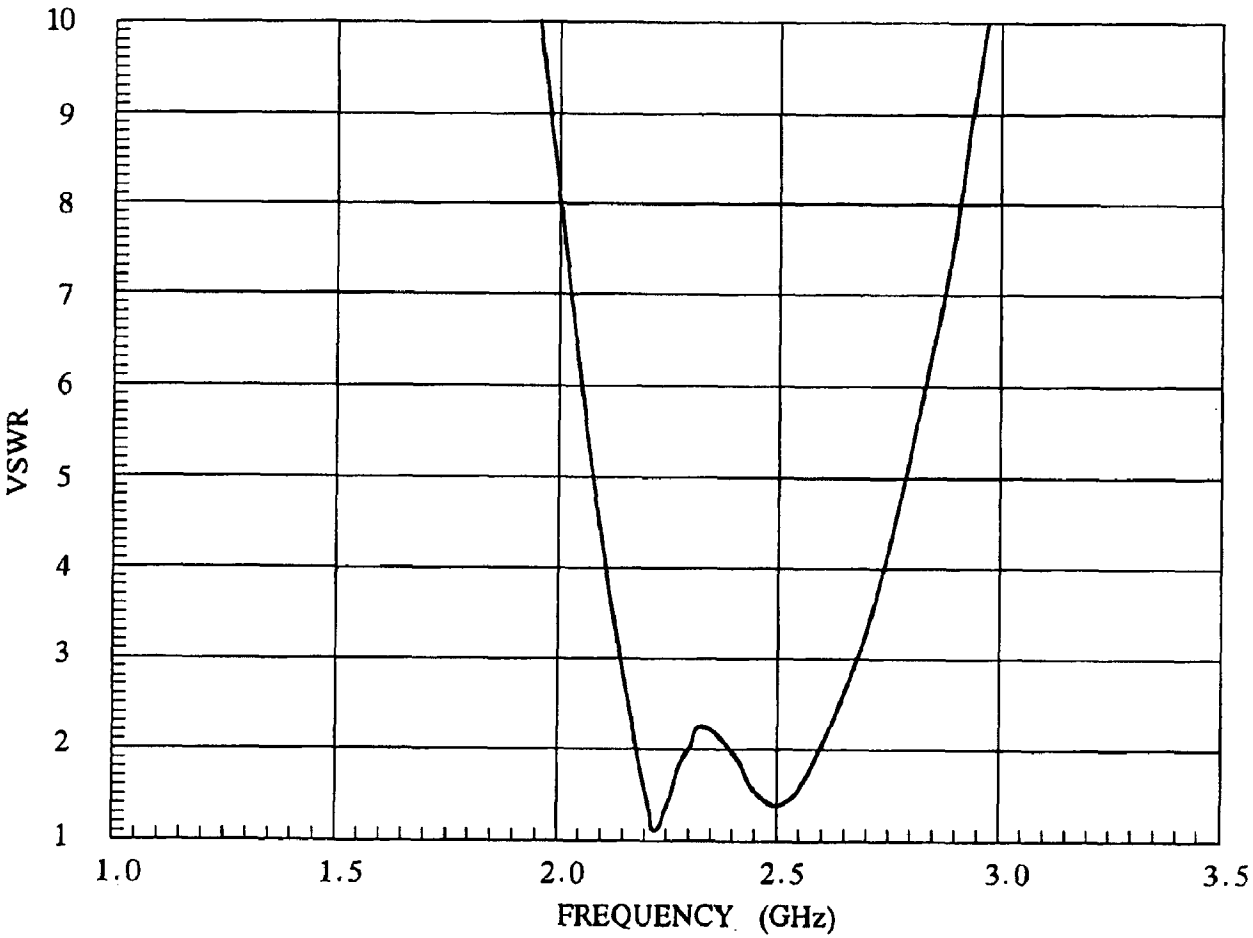
FIG. 5 is a diagram showing a VSWR characteristic in the first embodiment of the present invention.

The VSWR of the dielectric antenna 10 is the result of combination of the VSWRs of the individual antenna elements 13 and 14, as shown in FIG. 5. Therefore, the frequency bandwidth through which a low VSWR is exhibited is extended in comparison with the case where one of the antenna elements 13 and 14 is singly used, thereby enabling use in a wider band. In the VSWR characteristic shown in FIG. 5, small favorable VSWR values are exhibited, that is, the VSWR is 3 or less at 2.15 to 2.68 GHz, 1.1 at 2.25 GHz, and 1.4 at 2.50 GHz. Thus, in the dielectric antenna 10 of this embodiment, the bandwidth suitably usable in a used frequency band can be extended, as indicated by the characteristic curve.

Figure 6:
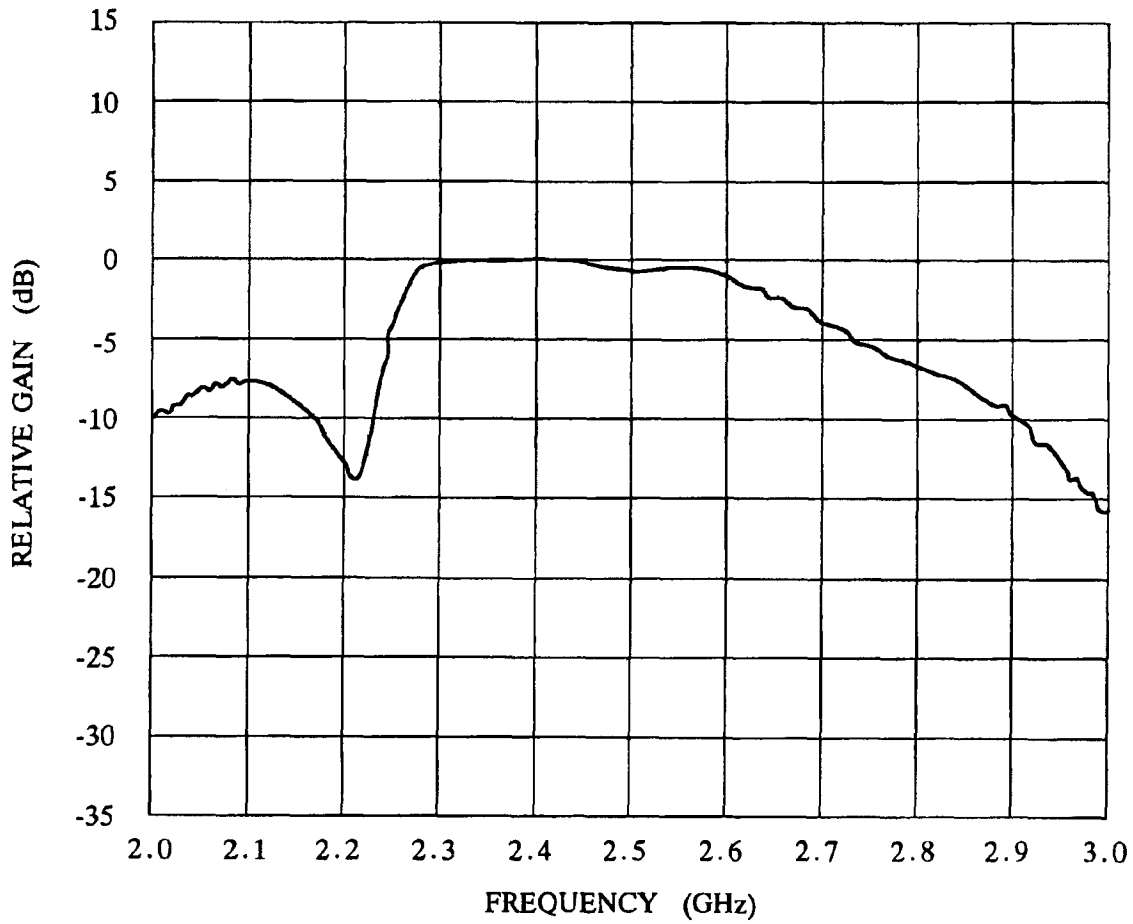
FIG. 6 is a diagram showing a relative gain characteristic in the first embodiment of the present invention.

Further, the dielectric antenna 10 has a gain characteristic such as shown in FIG. 6. In this characteristic, while the gain is 0 dB at a frequency of 2.3 to 2.6 GHz and at a frequency of 2.2 GHz in particular, it decreases gradually with the increase in frequency above 2.6 GHz, and is −10 dB or lower at a frequency about 2.2 GHz. Thus, an attenuation of 10 dB or more is attained out of the frequency band to be used and intermodulation with a signal at a frequency out of the band to be used can be prevented.

Figure 7:
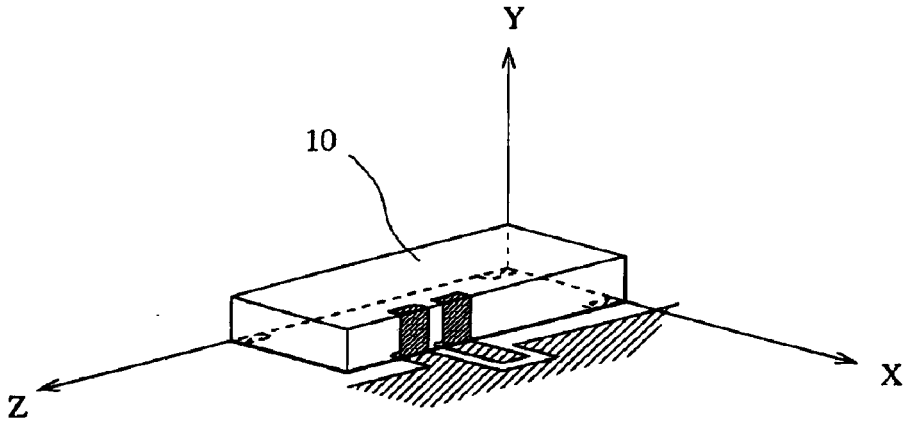
FIG. 7 is a diagram showing an XYZ coordinate system in radiant beam pattern measurement in the first embodiment of the present invention.
Figure 8:
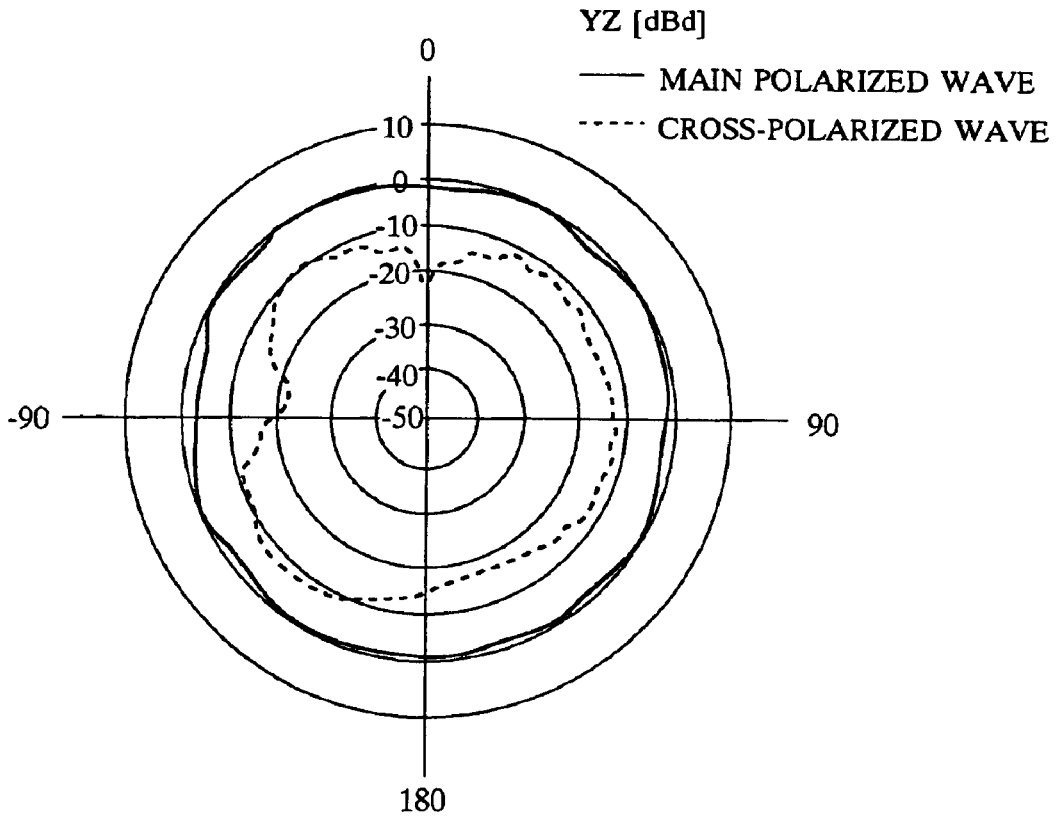
FIG. 8 is a diagram showing a radiant beam pattern in the YZ plane in the first embodiment of the present invention.
Figure 9:
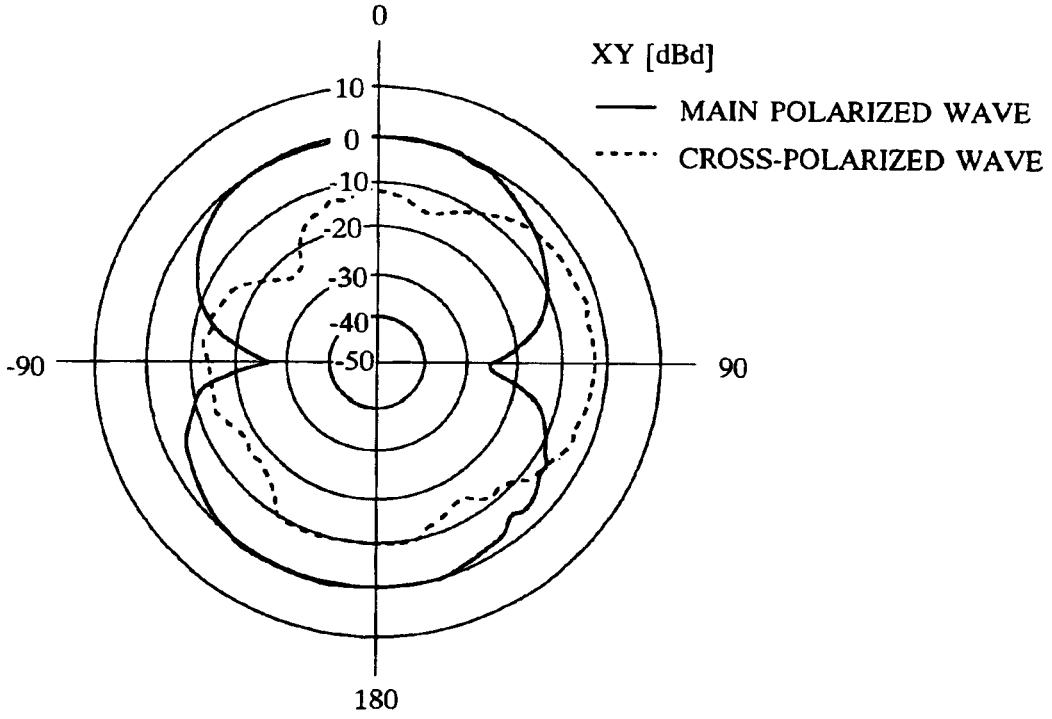
FIG. 9 is a diagram showing a radiant beam pattern in the XY plane in the first embodiment of the present invention.
Figure 10:
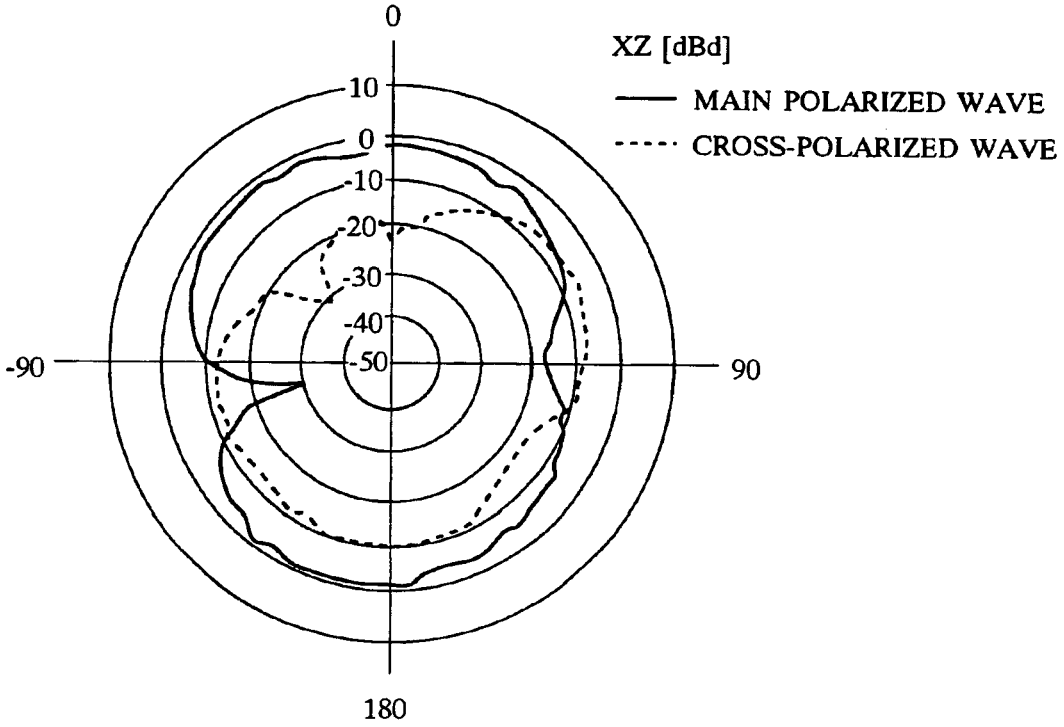
FIG. 10 is a diagram showing a radiant beam pattern in the XZ plane in the first embodiment of the present invention.

FIGS. 8 to 10 show radiant beam patterns when an XYZ coordinate system is set on the dielectric antenna 10 as shown in FIG. 7. The X-axis was set along the width W direction of the dielectric antenna 10, the Y-axis along the thickness D direction, and the Z-axis along the length L1 direction.

FIG. 8 shows a main polarized wave (solid line) and a cross-polarized wave (broken line) in the YZ plane. The main polarized wave is close to a circular state. FIG. 9 shows the main polarized wave (solid line) and the cross-polarized wave (broken line) in the XY plane. Also, FIG. 10 shows the main polarized wave (solid line) and the cross-polarized wave (broken line) in the XZ plane. Thus, favorable radiant beam patterns can be obtained.

Consequently, in use of the dielectric antenna 10 of this embodiment, when the dielectric antenna 10 is mounted on the circuit board 1, the distance L2 from the grounding conductor 3 formed on the circuit board 1 can be reduced in comparison that in the conventional arrangement, thus enabling great contribution to the miniaturization and integration of a cellular phone or a portable wireless communication device.

Figure 11:
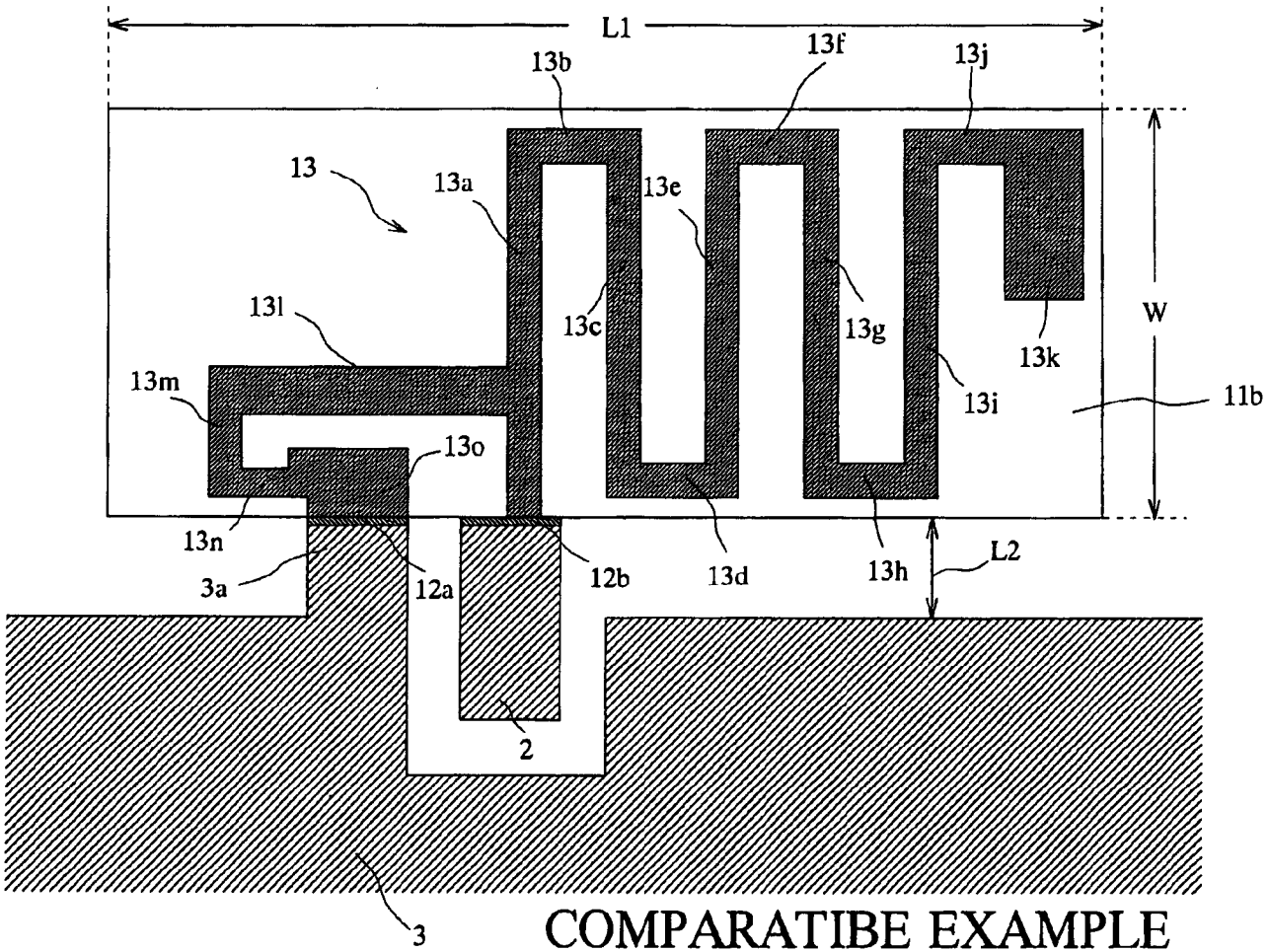
FIG. 11 is a plan view of a first antenna element in a comparative example for comparison with the first embodiment of the present invention.
Figure 12:
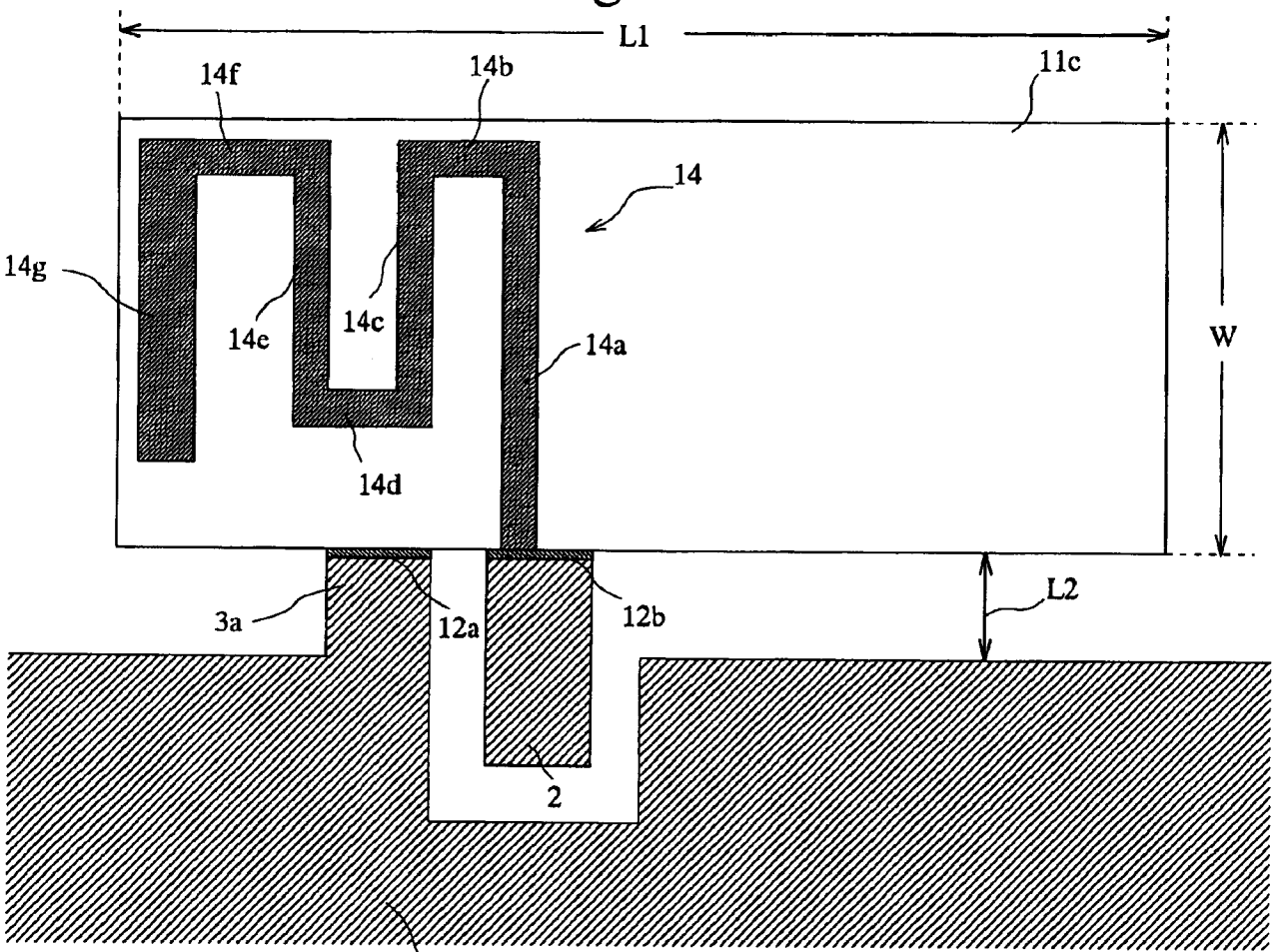
FIG. 12 is a plan view of a second antenna element in the comparative example for comparison with the first embodiment of the present invention.
Figure 13:
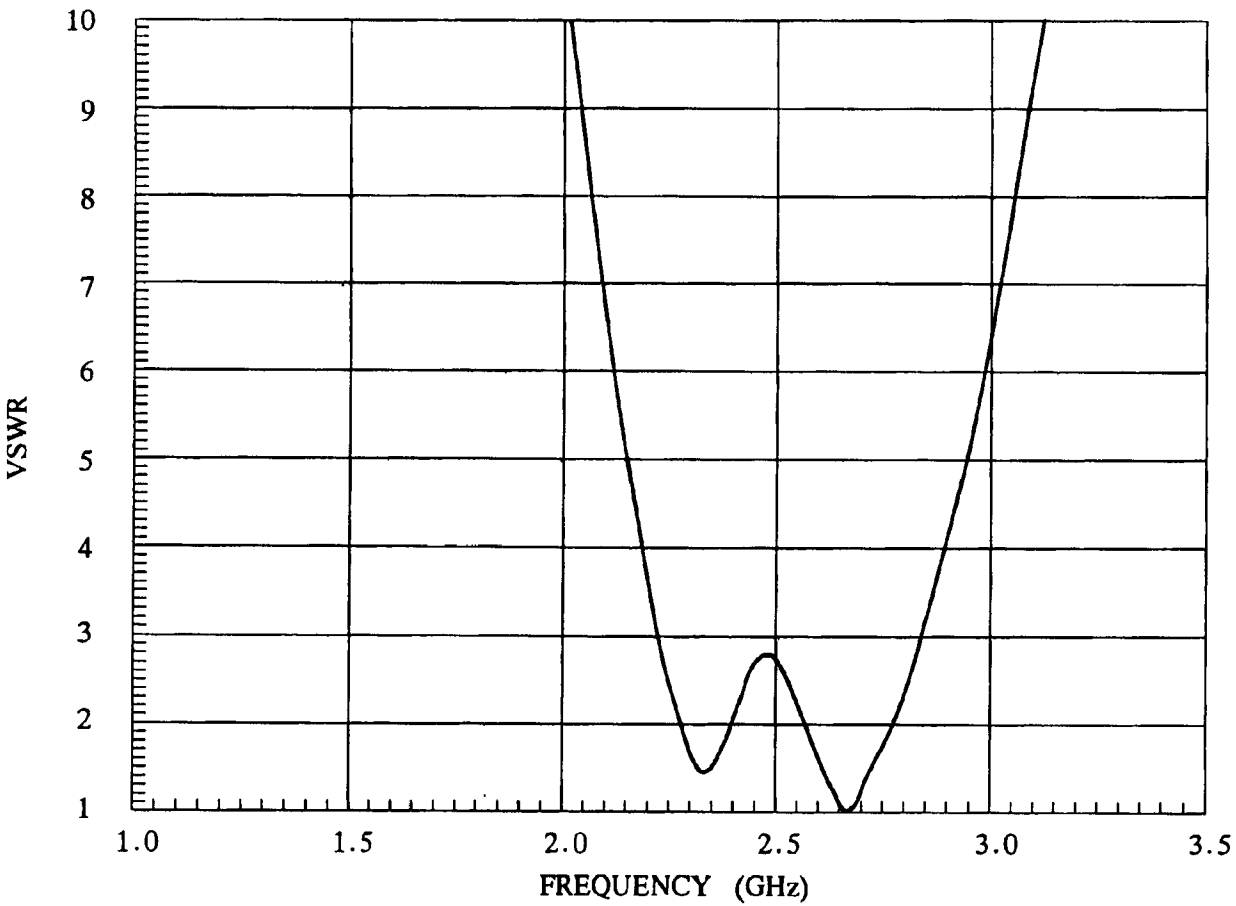
FIG. 13 is a diagram showing a VSWR characteristic in the comparative example for comparison with the first embodiment of the present invention.

FIGS. 11 to 13 shows a comparative example. FIG. 11 is a plan view of a first antenna element, FIG. 12 is a plan view of a second antenna element, and FIG. 13 is a diagram showing a VSWR characteristic. This comparative example is a dielectric antenna which is formed by removing the above-described open stub 15 from the above-described dielectric antenna 10, and which has the antenna elements 13 and 14 shown in FIGS. 11 and 12.

The VSWR characteristic shown in FIG. 13 was obtained when the dielectric antenna was mounted on the circuit board 1 by being spaced apart from the grounding conductor 3 on the circuit board 1 by the distance L2 (1 mm). In the case where the open stub 15 does not exist, small VSWR values are exhibited, that is, the VSWR is 3 or less at 2.22 to 2.84 GHz, 1.5 at 2.34 GHz, and 1.0 at 2.67 GHz. However, as a result of removal of the open stub 15, the resonance frequency is increased wholly by about 150 MHz. That is, to set the same resonance frequency as that in the first embodiment, it is necessary to increase the size of the antenna element by an amount for 150 MHz (about 6%) and to use a configuration for a larger size.

In the dielectric antenna 10 of the first embodiment, the open stub 15 is provided to enable control of the impedance including the state of coupling as well as adjustment of the resonance frequency. Thus, an effect other than the effect of achieving the 6% reduction rate can also be obtained.

Also, it is possible to change the resonance frequency and the feed point impedance by changing the length Lst and the width Wst of the open stub 15 or the position at which the open stub 15 and the conductor 14*a* are connected.

It is also possible to change the resonance frequency and the feed point impedance by changing the length and area of the conductors 13*k* and 14*g* in the end portions of the antenna elements 13 and 14 and the entire length and area of the conductors 13*l* to 13*o* connecting the feed point and the grounding terminal in the antenna element 13.

A dielectric antenna in a second embodiment of the present invention will next be described.

Figure 14:
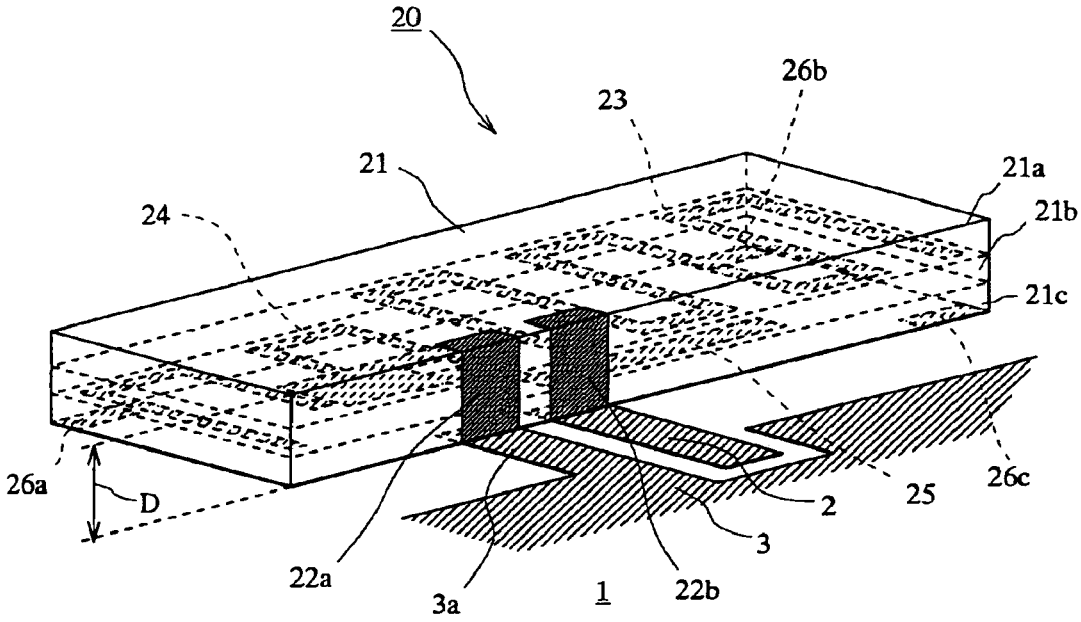
FIG. 14 is a see-through oblique perspective view of a dielectric antenna in a second embodiment of the present invention.
Figure 15:
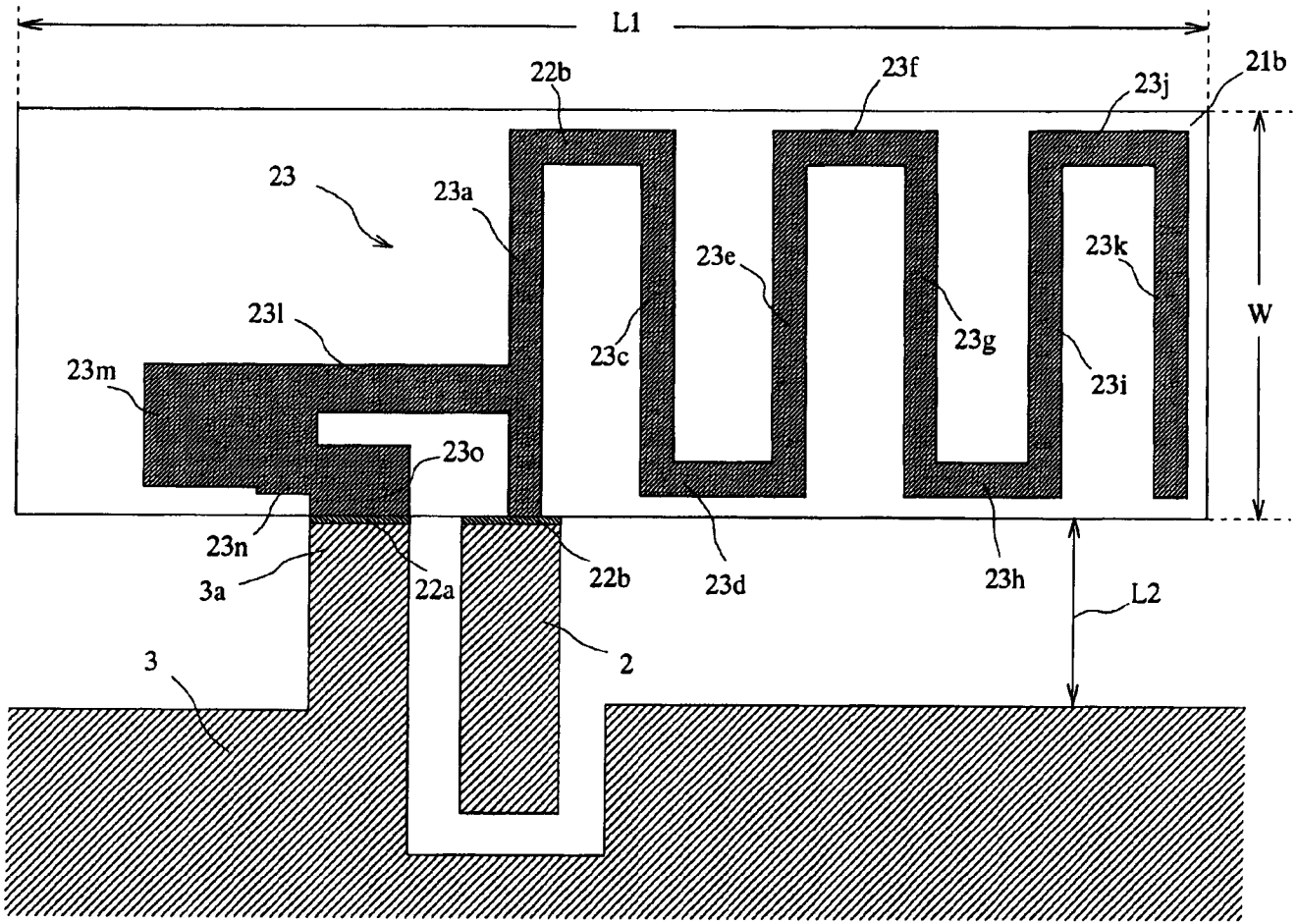
FIG. 15 is a plan view of a first antenna element in the second embodiment of the present invention.
Figure 16:
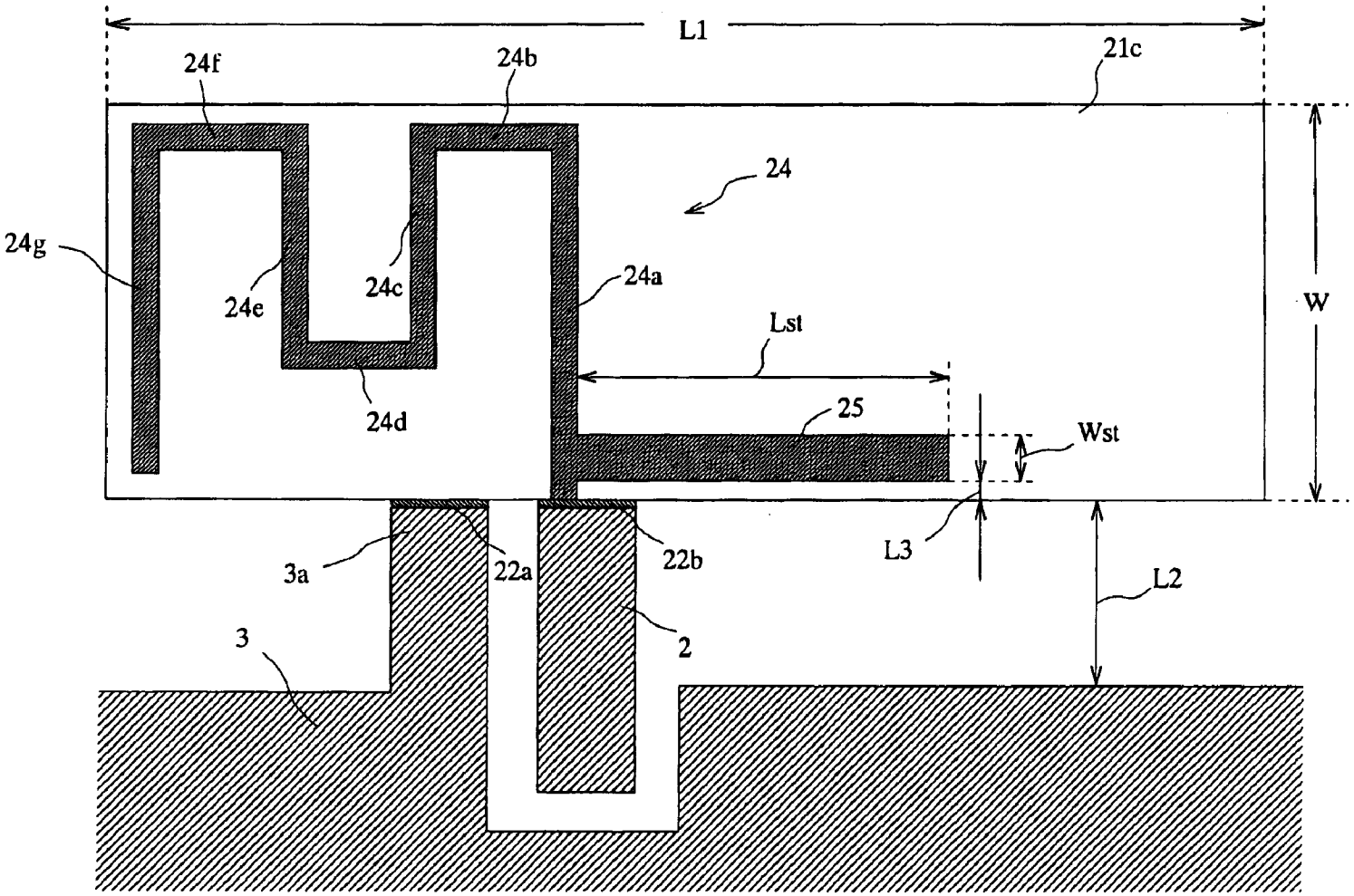
FIG. 16 is a plan view of a second antenna element in the second embodiment of the present invention.

As the second embodiment, a dielectric antenna for W-CDMA in the 2 GHz band was configured. FIG. 14 is a perspective see-through view of the dielectric antenna in the second embodiment of the present invention, FIG. 15 is a plan view of a first antenna element, and FIG. 16 is a plan view of a second antenna element.

Referring to the drawings, the dielectric antenna 20 has a laminated member 21 laminated from flat substrates 21*a*, 21*b*, and 21*c* (hereinafter referred to simply as "substrate") having an insulating property and made of a dielectric ceramic material. External terminals 22*a* and 22*b* are provided on one side surface of the laminated member 21.

Conductors which form the first antenna element (hereinafter referred to simply as "antenna element") 23 are provided on an upper surface of the intermediate layer substrate 21*b*. Also, conductors which form the second antenna element (hereinafter referred to simply as "antenna element") 24 are provided on an upper surface of the lower layer substrate 21*c*. Further, a plurality of dummy electrodes 26*a* to 26*c* are formed on a back surface of the lower layer substrate 21*c* to enable stable soldering fixation at the time of mounting on a circuit board 1.

The laminated member 21 has as its dimensions a length L1 of 12 mm, a width W of 4 mm, and a thickness D of 1 mm. In FIGS. 15 and 16, the sizes of portions are shown in the same proportion as the actual size proportions.

The antenna element 23 formed on the upper surface of the substrate 21*b* is formed of conductor strips 23*a* to 23*o*. The antenna element 23 is an element generally called an inverted F-type antenna. The resonance frequency of the antenna element 23 is set to, for example, 1.9 GHz and the feed point impedance of the antenna element 23 is set to, for example, about 100 Ω. One end of the conductor 23*a* is connected to the external terminal 22*b*, which is a feed point. The conductors 23*b* to 23*k* are connected to the other end of the conductor 23*a* by being connected in the described order while being folded so as to meander. Thus, the antenna element 23 is formed into the shape of a rectangular wave.

Also, conductors 23*l* to 23*o* are provided on the side of the conductor 23*a* opposite from the side on which the conductors 23*b* to 23*k* are placed. One end of the conductor 23*l* is perpendicularly connected to a portion of the conductor 23*a* at an intermediate position in the lengthwise direction. Further, one end of the conductor 23*m* is perpendicularly connected to the other end of the conductor 23*l*. One end of the conductor 23*n* is perpendicularly connected to the other end of the conductor 23*m*. The other end of the conductor 23*n* is connected through the conductor 23*o* to the external terminal 22*a*, which is a grounding terminal.

The antenna element 24 formed on the upper surface of the substrate 21*c* is formed of conductor strips 24*a* to 24*g*. The resonance frequency of the antenna element 24 is set to, for example, 2.2 GHz and the feed point impedance of the antenna element 24 is set to, for example, about 100 Ω. One end of the conductor 24*a* is connected to the external terminal 22*b*, which is a feed point, and the conductors 24*b* to 24*g* are connected to the other end of the conductor 24*a* by being connected in the described order while being folded so as to meander. Thus, the antenna element 24 is formed into the shape of a rectangular wave. These conductors 24*b* to 24*g* are placed so as to overlap the conductors 23*l* to 23*o* constituting the above-described antenna element 23, with the substrate 21*b* (dielectric layer) interposed therebetween.

Also, an open stub 25 formed of a rectangular conductor is provided on the opposite side of the conductor 24*a*. One end of the open stub 25 is perpendicularly connected to the conductor 24*a* at a position on the feed point side (external terminal 22*b* side) of a center of the conductor 24*a* in the lengthwise direction. Also, the open stub 25 has its length Lst set to 4.00 mm and its width Wst set to 0.5 mm. The distance L3 between the position at which the open stub 25 and the conductor 24*a* are connected and the feed point (external terminal 22*b*) is set to about 0.2 mm. Further, the open stub 25 is placed so as to be capacitive-coupled to the antenna element 23 at a plurality of positions with the substrate 21*b* interposed therebetween.

The feed points of the two antenna elements 23 and 24 are connected to the common external terminal 22*b* as in the above-described arrangement, so that the feed point impedance of dielectric antenna 20 is 50 Ω, the same value as the high-frequency input/output impedance ordinary set in high-frequency transmitting/receiving circuits.

When the dielectric antenna 20 is used, it is mounted on the circuit board 1 with the external terminal 22*a* for grounding connected to a connection land 3*a* of a grounding conductor 3 formed on the circuit board 1, and with the external terminal 22*b* for feed connected to a feed land 2 formed on the circuit board 1.

With the dielectric antenna 20 constructed as described above, the same effects as those in the first embodiment can also be obtained. That is, the open stub 25 is provided to enable the distance L2 from the grounding conductor 3 formed on the circuit board 1 to be reduced in comparison with that in the conventional arrangement when the dielectric antenna 20 is mounted on the circuit board 1. The dielectric antenna 20 of this embodiment was obtained with a good characteristic while the distance L2 from the grounding conductor 3 was set to 2 mm. Also, it was formed so as to be smaller in size than the conventional ones.

Further, since the open stub 25 is placed so as to be capacitive-coupled to the antenna element 23 at a plurality of positions with the substrate 21*b* interposed therebetween, capacitive coupling is provided between the antenna element 23 and the open stub 25 while an inductance component of the open stub 25 is connected in parallel with part of the antenna element 23, thereby further reducing the length of the antenna element 23.

Figure 17:
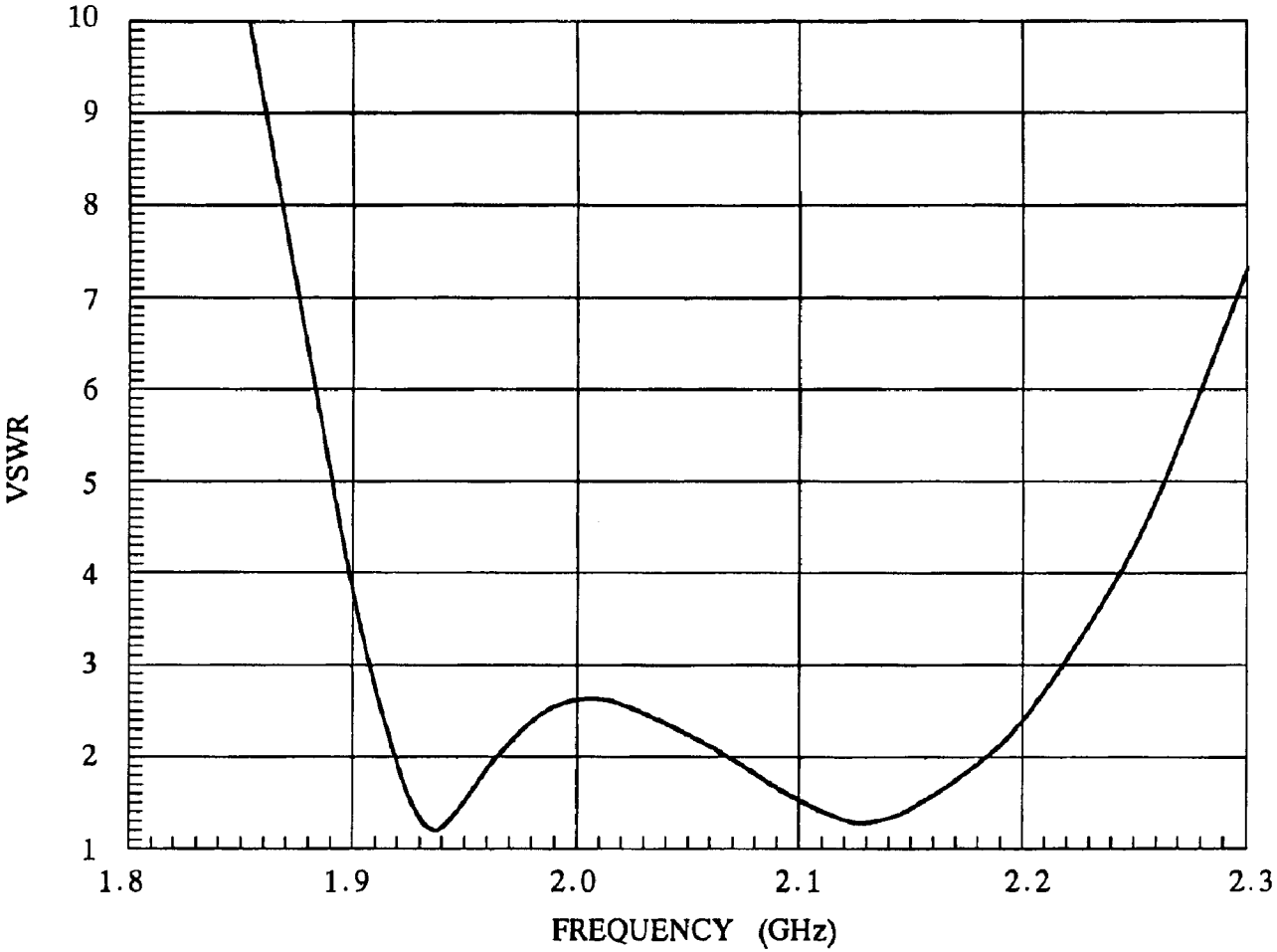
FIG. 17 is a diagram showing a VSWR characteristic in the second embodiment of the present invention.

The VSWR of the dielectric antenna 20 is the result of combination of the VSWRs of the individual antenna elements 23 and 24, as shown in FIG. 17. Therefore, the frequency bandwidth through which a low VSWR is exhibited is extended in comparison with the case where one of the antenna elements 23 and 24 is singly used, thereby enabling use in a wider band. In the VSWR characteristic shown in FIG. 17, a VSWR value of 2 or less at 1.92 to 1.965 GHz in the transmission frequency band from 1.92 to 1.98 GHz in W-CDMA was obtained, and the VSWR was 2.4 at 1.98 GHz. Also, a VSWR value of 1.8 or less was exhibited with respect to the reception frequency band from 2.11 to 2.17 GHz in W-CDMA. Thus, favorable VSWR values were obtained in the bandwidth ranging through 60 MHz in each of the transmission and reception frequency bands.

Also, the dielectric antenna 20 has the same radiant beam patterns as those shown in FIGS. 8 to 10.

Consequently, in use of the dielectric antenna 20 of this embodiment, when the dielectric antenna 20 is mounted on the circuit board 1, the distance L2 from the grounding conductor 3 formed on the circuit board 1 can be reduced in comparison that in the conventional arrangement, thus enabling great contribution to the miniaturization and integration of a cellular phone or a portable wireless communication device.

It is possible to change the resonance frequency and the feed point impedance by changing some of length Lst and width Wst of the open stub 25, the position at which the open stub 25 and the conductor 24*a* are connected, the length and area of the conductors 23*k* and 24*g* in the end portions of the antenna elements 23 and 24 and the entire length and area of the conductors 23*l* to 23*o* connecting the feed point and the grounding terminal in the antenna element 23.

A dielectric antenna in a third embodiment of the present invention will next be described.

An example of a 2.4 GHz band dielectric antenna presently used for mobile communication will be described as the third embodiment, as is that described as the first embodiment. In the third embodiment, the same open stub as that described above is provided and an end portion of antenna is branched to enable further miniaturization in comparison with first embodiment.

Figure 18:
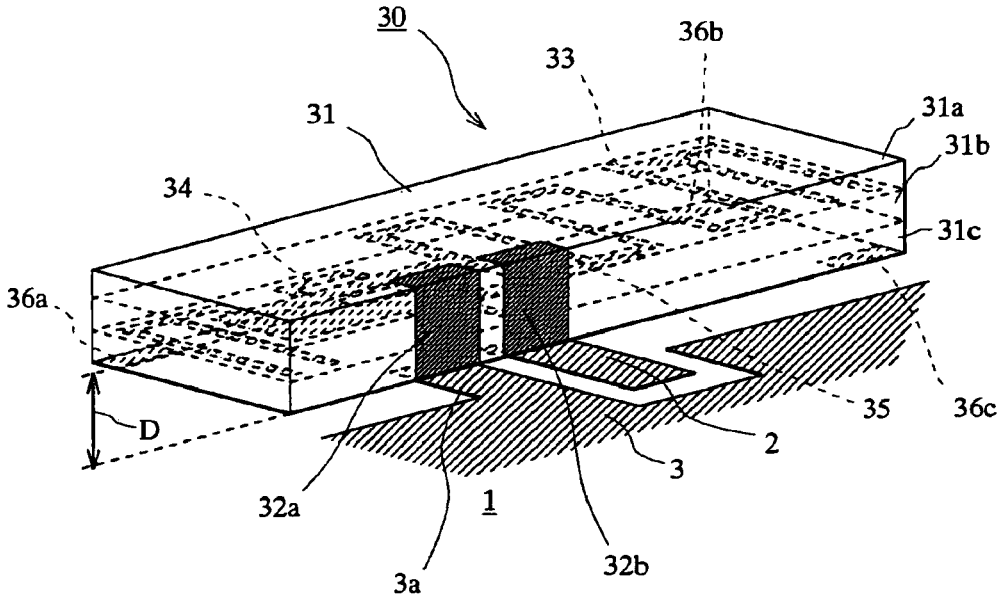
FIG. 18 is a see-through oblique perspective view of a dielectric antenna in a third embodiment of the present invention.
Figure 19:
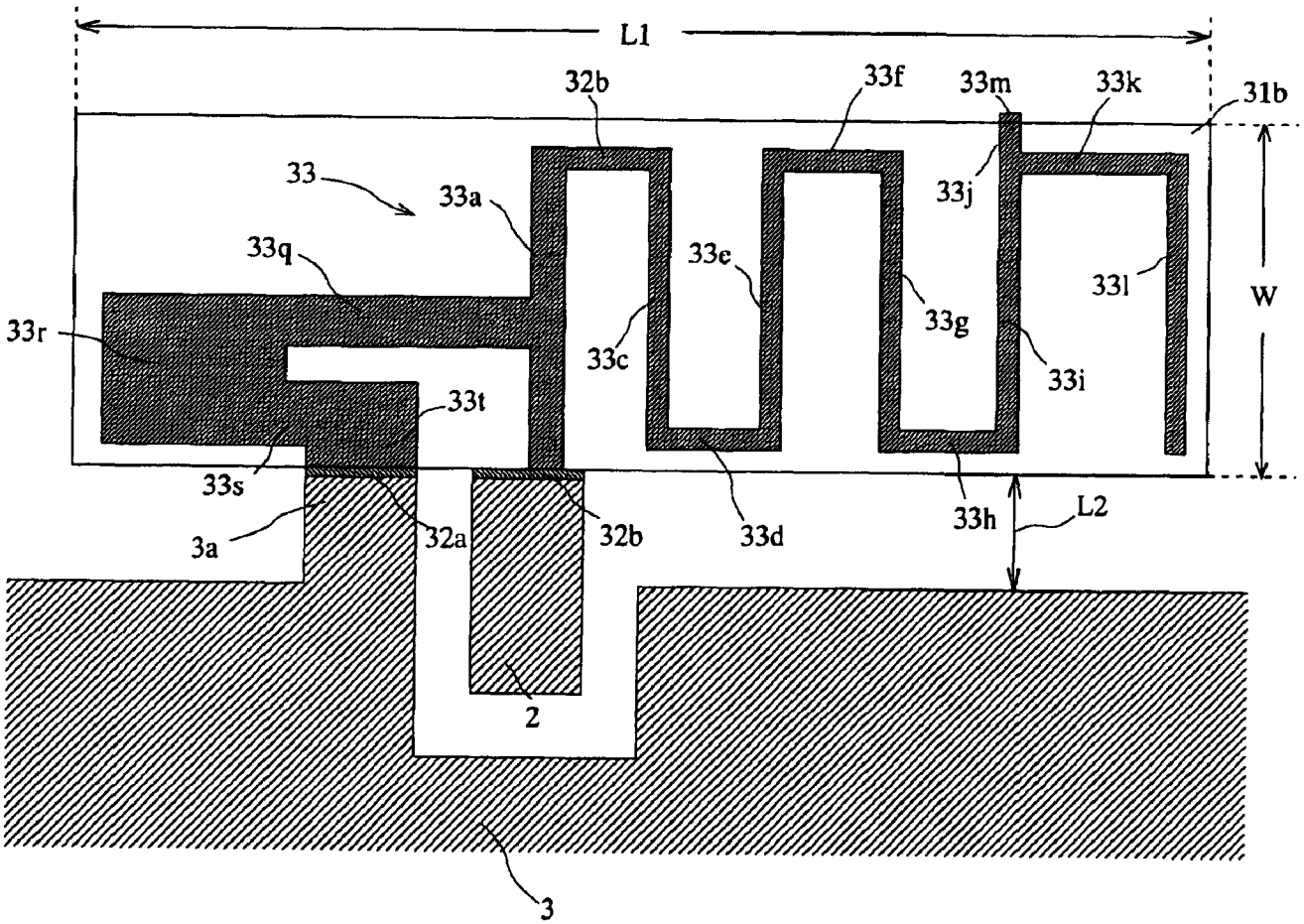
FIG. 19 is a plan view of a first antenna element in the third embodiment of the present invention.
Figure 20:
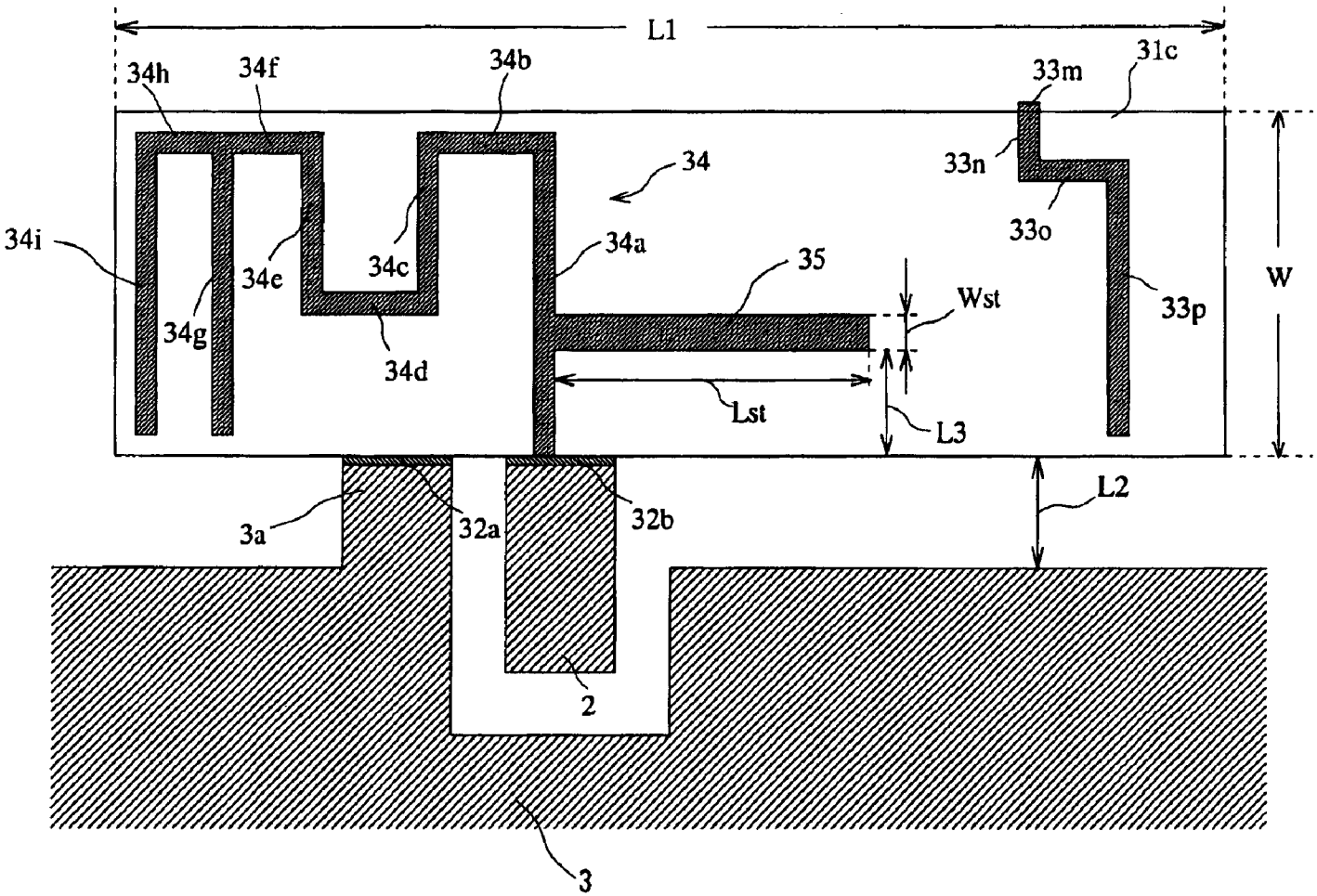
FIG. 20 is a plan view of a second antenna element in the third embodiment of the present invention.

FIG. 18 is a perspective see-through view of the dielectric antenna in the third embodiment of the present invention, FIG. 19 is a plan view of a first antenna element, and FIG. 20 is a plan view of a second antenna element.

Referring to these drawings, the dielectric antenna 30 has a laminated member 31 laminated from flat substrates 31*a*, 31*b*, and 31*c* (hereinafter referred to simply as "substrate") having an insulating property and made of a dielectric ceramic material. External terminals 32*a* and 32*b* are provided on one side surface of the laminated member 31.

Conductors which form the first antenna element (hereinafter referred to simply as "antenna element") 33 are provided on an upper surface of the intermediate layer substrate 31*b*. Also, conductors which form the second antenna element (hereinafter referred to simply as "antenna element") 34 are provided on an upper surface of the lower layer substrate 31*b*. Further, a plurality of dummy electrodes 36*a* to 36*c* are formed on a back surface of the lower layer substrate 31*c* to enable stable soldering fixation at the time of mounting on a circuit board 1.

The laminated member 31 has as its dimensions a length L1 of 10 mm, a width W of 3 mm, and a thickness D of 1 mm. In FIGS. 19 and 20, the sizes of portions are shown in the same proportion as the actual size proportions.

The antenna element 33 formed on the upper surface of the substrate 31*b* is formed of conductor strips 33*a* to 33*t*. The antenna element 33 is an element generally called an inverted F-type antenna. The resonance frequency of the antenna element 33 is set to, for example, 2.4 GHz and the feed point impedance of the antenna element 33 is set to, for example, about 100 Ω. One end of the conductor 33*a* is connected to the external terminal 32*b*, which is a feed point. The conductors 33*b* to 33*i* are connected to the other end of the conductor 33*a* by being connected in the described order while being folded so as to meander. Thus, the antenna element 33 is formed into the shape of a rectangular wave. Further, the conductors 33*j* and 33*k* are connected to an end of the conductor 33*i* so as to diverge in different directions. The conductor 33*k* is extended in a direction perpendicular to the conductor 33*i*, and the conductor 33*l* is perpendicularly connected to an end of the conductor 33*k*. The conductor 33*m* provided on a side surface of the laminated member 31 is connected to an end of the conductor 33*j*, and the conductor 33*j* is connected through the conductor 33*m* to the conductor 33*n* provided on the substrate 31*c*. An end of the conductor 33*o* placed parallel to the conductor 33*k* is perpendicularly connected to the other end of the conductor 33*n*. Further, one end of the conductor 33*p* is perpendicularly connected to the other end of the conductor 33*o*.

The above-described conductors 33*a*, 33*c*, 33*e*, 33*g*, 33*i*, 33*l*, and 33*p* are placed parallel to each other. The spacing between the conductor 33*l* and 33*p* which are branches in an end portion of the antenna element 33 is set to 0.55 mm, and the spacing between the conductor 33*i* and the conductor 33*p* is set to 0.6 mm. The width of each of the conductors 33*l* and 33*p* is set to 0.2 mm, the length of the conductor 33*l* is set to 2.4 mm, and the length of the conductor 33*p* is set to 2.2 mm.

Thus, the end portion of the antenna element 33 is branched into two: the branch formed of the conductors 33*k* and 33*l* and the branch formed of the conductors 33*j* and 33*m* to 33*p*. An electrostatic capacity is thereby produced between the two branches and the grounding conductor near the branches. By this electrostatic capacity, the antenna element 33 forms a head capacity type of antenna. The length of the antenna element 33 resonating at 2.4 GHz is thereby reduced.

Also, conductors 33*q* to 33*t* are provided on the side of the conductor 33*a* opposite from the side on which the conductors 33*b* to 33*p* are placed. One end of the conductor 33*q* is perpendicularly connected to a portion of the conductor 33*a* at an intermediate position in the lengthwise direction. One end of the conductor 33*r* is perpendicularly connected to the other end of the conductor 33*q*. One end of the conductor 33*s* is perpendicularly connected to the other end of the conductor 33*r*. The other end of the conductor 33*s* is connected through the conductor 33*t* to the external terminal 32*a*, which is a grounding terminal.

The antenna element 34 formed on the upper surface of the substrate 31*c* is formed of conductor strips 34*a* to 34*i*. The resonance frequency of the antenna element 34 is set to, for example, 2.5 GHz and the feed point impedance of the antenna element 34 is set to, for example, about 100 Ω. One end of the conductor 34*a* is connected to the external terminal 32*b*, which is a feed point, and the conductors 34*b* to 34*f* are connected to the other end of the conductor 34*a* by being connected in the described order while being folded so as to meander. Thus, the antenna element 34 is formed into the shape of a rectangular wave.

Further, the conductors 34*g* and 34*h* are connected to an end of the conductor 34*f* so as to diverge in different directions, and the conductor 34*i* is perpendicularly connected to an end of the conductor 34*h*.

These conductors 34*b* to 34*g* are placed on the side where the conductors 33*o* to 33*r* constituting the above-described antenna element 33 are placed, and the above-described conductors 34*a*, 34*c*, 34*e*, 34*g*, and 34*i* are placed parallel to each other.

The spacing between the conductor 34*g* and 34*i* which are branches in an end portion of the antenna element 34 is set to 0.5 mm, and the spacing between the conductor 34*g* and the conductor 34*e* is set to 0.65 mm. The width of each of the conductors 3*g* and 34*i* is set to 0.2 mm, and the length of each of the conductors 34*g* and 34*i* is set to 2.4 mm.

Thus, the end portion of the antenna element 34 is branched into two. An electrostatic capacity is thereby produced between the branches 34*g* and 34*i* and the grounding conductor near the branches. By this electrostatic capacity, the antenna element 33 forms a head capacity type of antenna. The length of the antenna element 34 resonating at 2.5 GHz is thereby reduced.

Also, an open stub 35 formed of a rectangular conductor is provided on the opposite side of the conductor 34*a*. One end of the open stub 35 is perpendicularly connected to a portion of the conductor 34*a* at an intermediate position in the lengthwise direction. Also, the open stub 35 has its length Lst set to 2.75 mm and its width Wst set to 0.3 mm. The distance L3 between the position at which the open stub 35 and the conductor 34*a* are connected and the feed point (external terminal 32*b*) is set to about 0.9 mm. The open stub 35 is placed so as to be capacitive-coupled to the antenna element 33 at a plurality of positions with the substrate 31*b* interposed therebetween.

The feed points of the two antenna elements 33 and 34 are connected to the common external terminal 32*b* as in the above-described arrangement, so that the feed point impedance of dielectric antenna 30 is 50 Ω, the same value as the high-frequency input/output impedance ordinary set in high-frequency transmitting/receiving circuits.

When the dielectric antenna 30 is used, it is mounted on the circuit board 1 with the external terminal 32*a* for grounding connected to a connection land 3*a* of a grounding conductor 3 formed on the circuit board 1, and with the external terminal 32*b* for feed connected to a feed land 2 formed on the circuit board 1.

With the dielectric antenna 30 constructed as described above, the same effects as those in the first embodiment can also be obtained. That is, the open stub 35 is provided to enable the distance L2 from the grounding conductor 3 formed on the circuit board 1 to be reduced in comparison with that in the conventional arrangement when the dielectric antenna 30 is mounted on the circuit board 1. The dielectric antenna 30 of this embodiment was obtained with a good characteristic while the distance L2 from the grounding conductor 3 was set to 1 mm.

Further, in the third embodiment, the end portions of the antenna elements 33 and 34 are branched to further reduce the size of the antenna elements and to improve the characteristics in comparison with the first embodiment.

That is, since the open stub 35 is placed so as to be capacitive-coupled to the antenna element 33 at a plurality of positions with the substrate 31*b* interposed therebetween, capacitive coupling is provided between the antenna element 33 and the open stub 35 while an inductance component of the open stub 35 is connected in parallel with part of the antenna element 33, thereby further reducing the length of the antenna element 33.

Also, since the end portions of the antenna elements 33 and 34 are branched as described above, an electrostatic capacity is produced between each branch conductor and the grounding conductor near the branch conductor. By this electrostatic capacity, each of the antenna element 33 and 34 forms a head capacity type of antenna. Therefore the lengths of the antenna elements 33 and 34 are further reduced.

Figure 21:
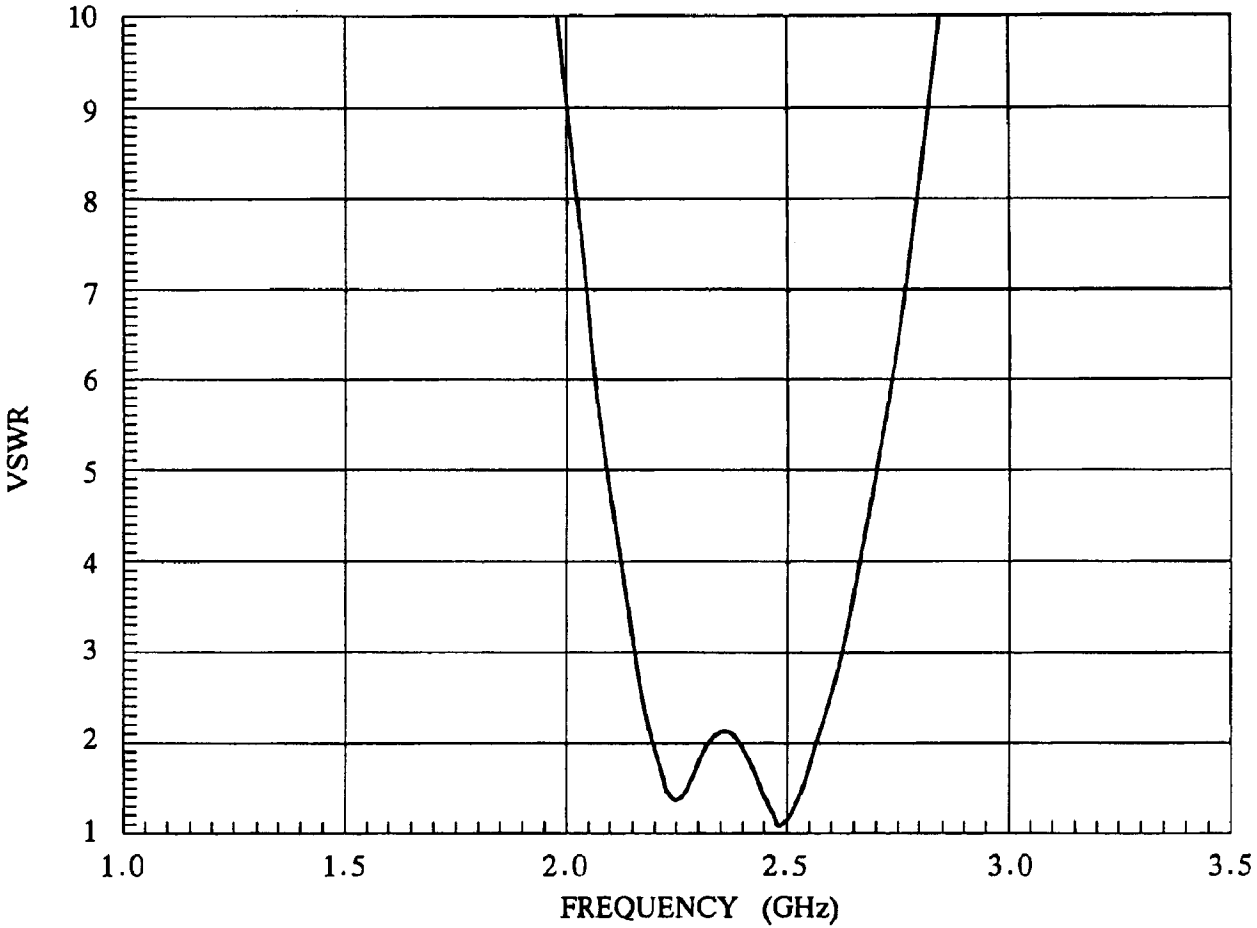
FIG. 21 is a diagram showing a VSWR characteristic in the third embodiment of the present invention.

The VSWR of the dielectric antenna 30 is the result of combination of the VSWRs of the individual antenna elements 33 and 34, as shown in FIG. 21. Therefore, the frequency bandwidth through which a low VSWR is exhibited is extended in comparison with the case where one of the antenna elements 33 and 34 is singly used, thereby enabling use in a wider band. In the VSWR characteristic shown in FIG. 21, low favorable VSWR values are exhibited, that is, the VSWR is 3 or less at 2.15 to 2.66 GHz, and 1.4 at 2.25 GHz, and 1.1 at 2.48 GHz. Thus, in the dielectric antenna 30 of this embodiment, the bandwidth suitably usable in a used frequency band can be extended, as indicated by the characteristic curve.

Further, the dielectric antenna 30 has a gain characteristic such as shown in FIG. 6 and the same radiant beam patterns as those shown in FIGS. 8 to 10.

Consequently, in use of the dielectric antenna 30 of this embodiment, when the dielectric antenna 30 is mounted on the circuit board 1, the distance L2 from the grounding conductor 3 formed on the circuit board 1 can be reduced in comparison that in the conventional arrangement, thus enabling great contribution to the miniaturization and integration of a cellular phone or a portable wireless communication device.

Also, as in the above-described first and second embodiments, it is possible to change the resonance frequency and the feed point impedance by changing some of the length Lst and width Wst of the open stub 35, the position at which the open stub 35 and the conductor 34*a* are connected, the length and area of the conductors 33*j* to 33*p*, 34*g*, and 34*i* in the end portions of the antenna elements 33 and 34, and the entire length and area of the conductors 33*q* to 33*t* connecting the feed point and the grounding terminal in the antenna element 33.

A dielectric antenna in a fourth embodiment of the present invention will next be described.

An example of a dielectric antenna for two frequency bands: the 2.4 GHz band presently used for mobile communication and the 5.2 GHz band used for wireless LAN or the like will be described as the fourth embodiment. In the fourth embodiment, the same open stub as that described above is provided and the setting of the meander pitch (meander spacing) of the first antenna element 13 is varied to enable use in the 5.2 GHz band, in which the dielectric antenna of the first embodiment cannot be used because the VSWR is high.

Figure 22:
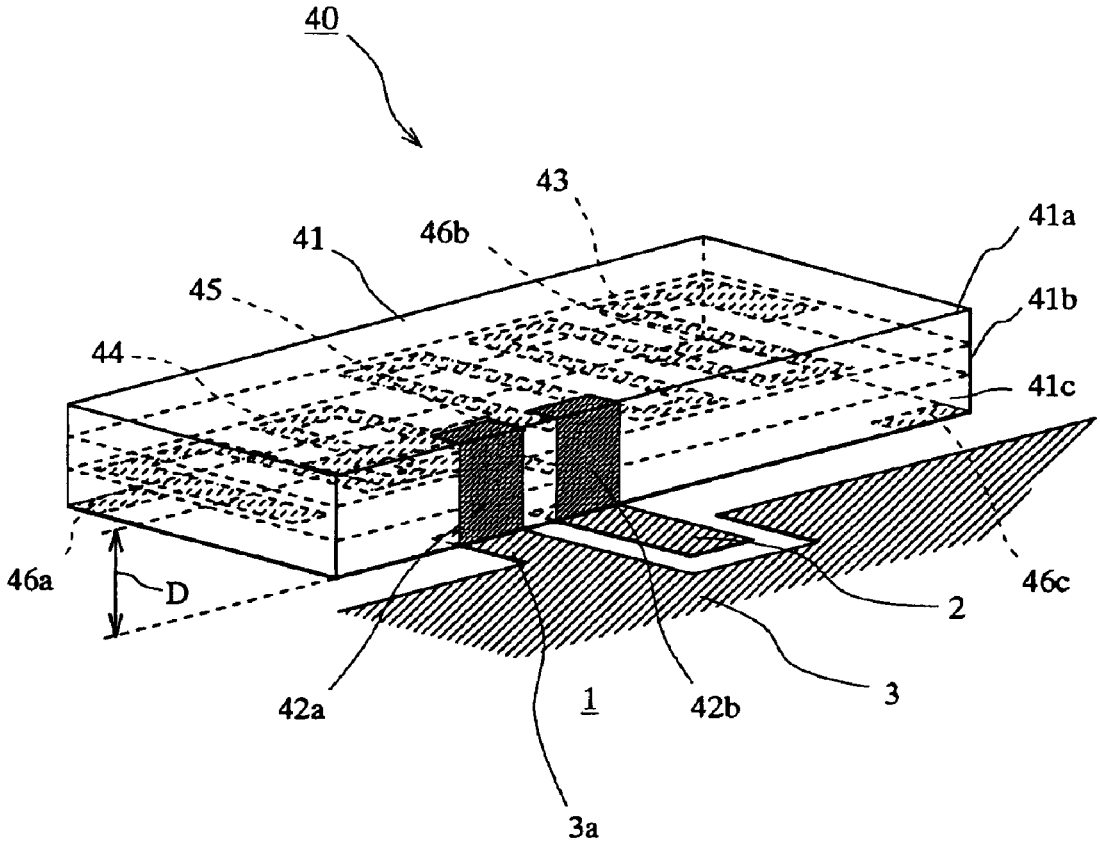
FIG. 22 is a see-through oblique perspective view of a dielectric antenna in a fourth embodiment of the present invention.
Figure 23:
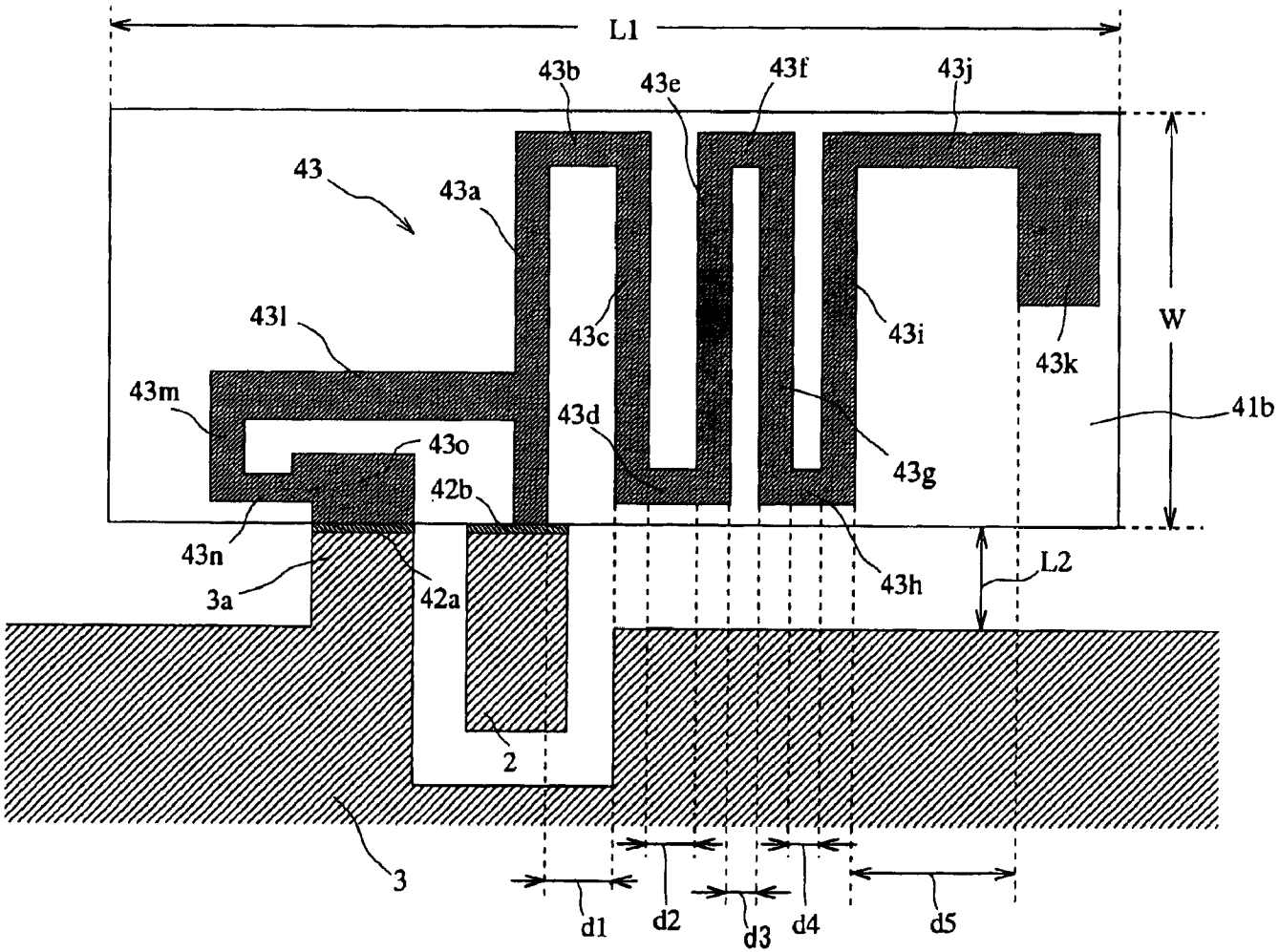
FIG. 23 is a plan view of a first antenna element in the fourth embodiment of the present invention.
Figure 24:
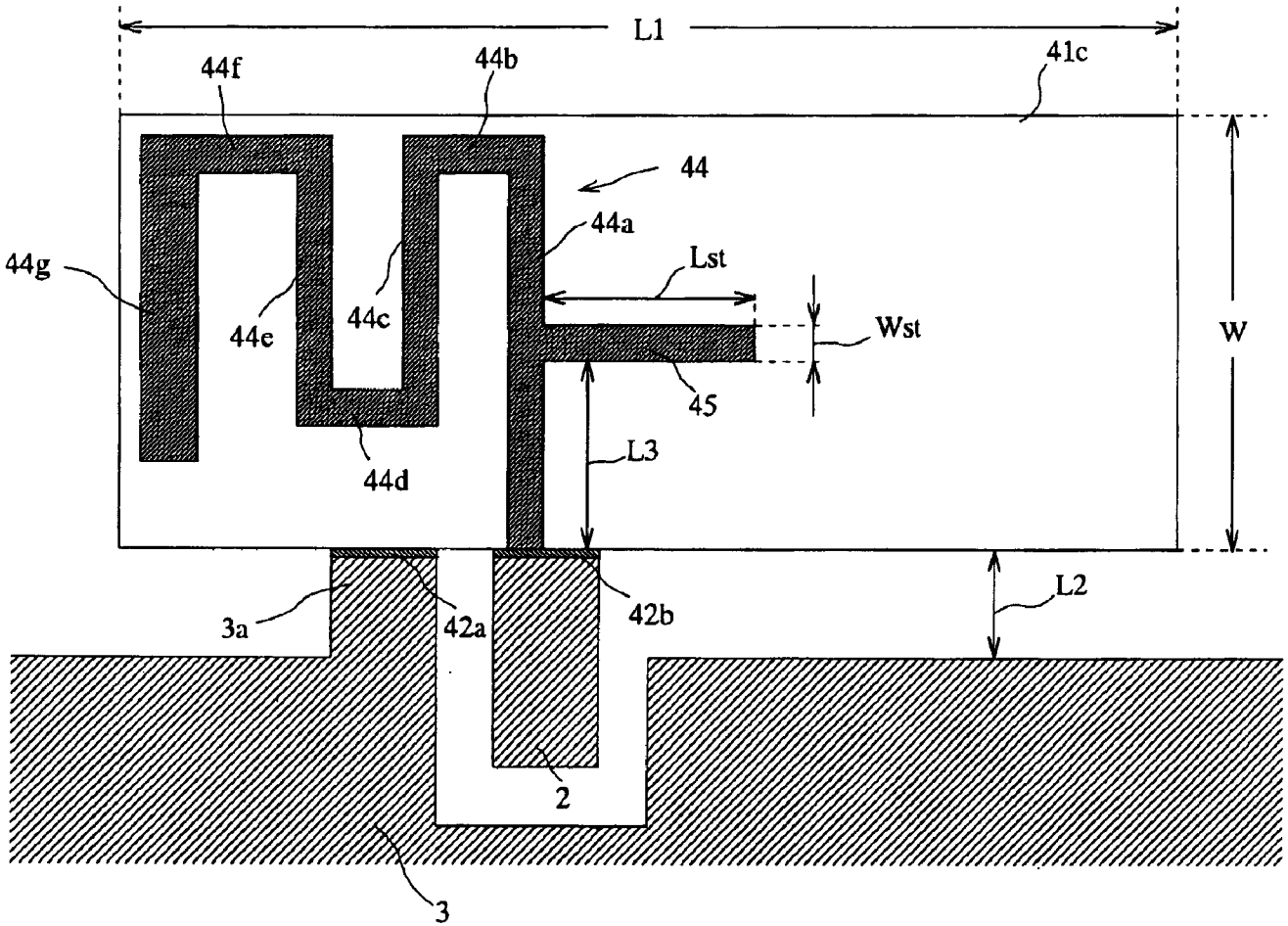
FIG. 24 is a plan view of a second antenna element in the fourth embodiment of the present invention.

FIG. 22 is a perspective see-through view of the dielectric antenna in the fourth embodiment of the present invention, FIG. 23 is a plan view of the first antenna element, and FIG. 24 is a plan view of the second antenna element.

Referring to the drawings, the dielectric antenna 40 has a laminated member 41 laminated from flat substrates 41*a*, 41*b*, and 41*c* (hereinafter referred to simply as "substrate") having an insulating property and made of a dielectric ceramic material. External terminals 42*a* and 42*b* are provided on one side surface of the laminated member 41.

Conductors 43*a* to 43*o* which form the first antenna element (hereinafter referred to simply as "antenna element") 43 are provided on an upper surface of the intermediate layer substrate 41*b*. Also, conductors 44*a* to 44*g* which form the second antenna element (hereinafter referred to simply as "antenna element") 44 are provided on an upper surface of the lower layer substrate 41*c*. Further, a plurality of dummy electrodes 46*a* to 46*c* are formed on a back surface of the lower layer substrate 41*c* to enable stable soldering fixation at the time of mounting on a circuit board 1.

The laminated member 41 has as its dimensions a length L1 of 10 mm, a width W of 4 mm, and a thickness D of 1 mm. In FIGS. 23 and 24, the sizes of portions are shown in the same proportion as the actual size proportions.

The antenna element 43 formed on the upper surface of the substrate 41*b* is formed of conductor strips 43*a* to 43*o*. The antenna element 43 is an element generally called an inverted F-type antenna. The resonance frequency of the antenna element 43 is set to, for example, 2.4 GHz and the feed point impedance of the antenna element 43 is set to, for example, about 100 Ω. One end of the conductor 43*a* is connected to the external terminal 42*b*, which is a feed point. The conductors 43*b* to 43*k* are connected to the other end of the conductor 43*a* by being connected in the described order while being folded so as to meander. The antenna element 43 is formed into the shape of a rectangular wave.

The conductor 43*k* in an end portion of the antenna element 43 is formed so as to be larger in width than the conductor 43*j* adjacent to the end portion. The conductor 43*k* is formed so as to have a larger area.

An electrostatic capacity is produced between the conductor 43*k* and a grounding conductor located near the conductor 43*k* by forming the conductor 43*k* so that the area of the conductor 43*k* is larger as described above. By this electrostatic capacity, the antenna element 43 forms a head capacity type of antenna. The length of the antenna element 43 resonating at 2.4 GHz is thereby reduced.

Meander spacings (meander pitches) d1 to d5 of the element having a rectangular shape (meander shape) and formed by the conductors 44*a* to 44*k* are set to different values. That is, the spacings between the adjacent pairs of the conductors 13*a*, 13*c*, 13*e*, 13*g*, and 13*i*, i.e., the spacing d1 between the conductor 13*a* and the conductor 13*c*, the spacing d2 between the conductor 13*c* and the conductor 13*e*, the spacing d3 between the conductor 13*e* and the conductor 13*g*, and the spacing d4 between the conductor 13*g* and the conductor 13*i*, the spacing d5 between the conductor 13*i* and the conductor 13*k* are set to values different from each other. The high-order resonance frequencies were varied by setting the meander spacing (meander pitch) in this manner without changing the entire length of the antenna element 43. The VSWR was thereby reduced to such a level that transmitting and receiving in the 5.2 GHz band can be performed.

That is, the electrostatic capacity between each adjacent pair of the conductors 13*a*, 13*c*, 13*e*, 13*g*, and 13*i* has no influence on frequencies in the 2.5 GHz band, but influences frequencies equal to or higher than 5 GHz to change high-order resonance frequencies equal to or higher than 5 GHz. The high-order resonance frequencies are lowered by reducing the spacings between the conductors 13*a*, 13*c*, 13*e*, 13*g*, and 13*i*. Also, the high-order resonance frequencies are increased by widening the spacings between the conductors 13*a*, 13*c*, 13*e*, 13*g*, and 13*i*. In the fourth embodiment, the high-order resonance frequencies are lowered by reducing the spacings between the conductors 13*a*, 13*c*, 13*e*, 13*g*, and 13*i* to reduce the VSWR to such a level that transmitting and receiving in the 5.2 GHz band can be performed.

On the other hand, conductors 43*l* to 43*o* are provided on the side of the conductor 43*a* opposite from the side on which the conductors 43*b* to 43*k* are placed. One end of the conductor 43*l* is perpendicularly connected to a portion of the conductor 43*a* at an intermediate position in the lengthwise direction. Further, one end of the conductor 43*m* is perpendicularly connected to the other end of the conductor 43*l*. One end of the conductor 43*n* is perpendicularly connected to the other end of the conductor 43*m*. The other end of the conductor 43*n* is connected through the conductor 43*o* to the external terminal 42*a*, which is a grounding terminal.

The antenna element 44 formed on the upper surface of the substrate 41*c* is formed of conductor strips 44*a* to 44*g*. The resonance frequency of the antenna element 44 is set to, for example, 2.5 GHz and the feed point impedance of the antenna element 44 is set to, for example, about 100 Ω. One end of the conductor 44*a* is connected to the external terminal 42*b*, which is a feed point, and the conductors 44*b* to 44*g* are connected to the other end of the conductor 44*a* by being connected in the described order while being folded so as to meander. The antenna element 44 is formed into the shape of a rectangular wave. These conductors 44*b* to 44*g* are placed on the side where the conductors 43*l* to 43*o* constituting the above-described antenna element 43 are placed.

Further, the conductor 44*g* in an end portion of the antenna element 44 is formed so as to be larger in width than the conductor 44*f* adjacent to the end portion. The area of the conductor 44*g* is increased to produce an electrostatic capacity between the conductor 44*g* and the grounding conductor located near the conductor 44*g*. By this electrostatic capacity, the antenna element 44 forms a head capacity type of antenna. The length of the antenna element 44 resonating at 2.5 GHz is thereby reduced.

Also, an open stub 45 formed of a rectangular conductor is provided on the opposite side of the conductor 44*a*. One end of the open stub 45 is perpendicularly connected to a portion of the conductor 44*a* at an intermediate position in the lengthwise direction. The open stub 45 has its length Lst set to about 2 mm and its width Wst set to 0.3 mm. Further, the distance L3 between the position at which the open stub 45 and the conductor 44*a* are connected and the feed point (external terminal 42*b*) is set to about 2 mm. Also, the open stub 45 is placed so as to be capacitive-coupled to the antenna element 43 at a plurality of positions with the substrate 41*b* interposed therebetween.

When the dielectric antenna 40 is used, it is mounted on the circuit board 1 with the external terminal 42*a* for grounding connected to a connection land 3*a* of a grounding conductor 3 formed on the circuit board 1, and with the external terminal 42*b* for feed connected to a feed land 2 formed on the circuit board 1.

In the dielectric antenna 40 constructed as described above, the open stub 45 is provided to enable the distance L2 from the grounding conductor 3 formed on the circuit board 1 to be reduced in comparison with that in the conventional arrangement when the dielectric antenna 40 is mounted on the circuit board 1. The dielectric antenna 40 of this embodiment was obtained with a good characteristic while the distance L2 from the grounding conductor 3 was set to 1 mm. Also, it was formed so as to be smaller in size than the conventional ones. Further, the meander spacing (meander pitch) of the antenna element 43 was set as described above to vary the high-order resonance frequencies, thereby making it possible to attain a VSWR value such that transmitting and receiving in the 5.2 GHz band can be performed.

That is, in the dielectric antenna 40, since the feed points of the two antenna elements 43 and 44 are connected to the common external terminal 42*b*, the feed point impedance at the external terminal 42*b* is 50 Ω, the same value as the high-frequency input/output impedance ordinary set in high-frequency transmitting/receiving circuits.

Further, in the dielectric antenna 40, since the open stub 45 is placed so as to be capacitive-coupled to the antenna element 43 at a plurality of positions with the substrate 41*b* interposed therebetween, capacitive coupling is provided between the antenna element 43 and the open stub 45 while an inductance component of the open stub 45 is connected in parallel with part of the antenna element 43, thereby further reducing the length of the antenna element 43.

Also, as described above, an electrostatic capacity is produced between the conductor 43*k* or 44*g* in the end portion of the antenna element 43 or 44 and the grounding conductor near the conductor, and each of the antenna elements 43 and 44 forms a head-capacity antenna by the electrostatic capacity, so that the length of each of the antenna elements 43 and 44 is further reduced.

Figure 25:
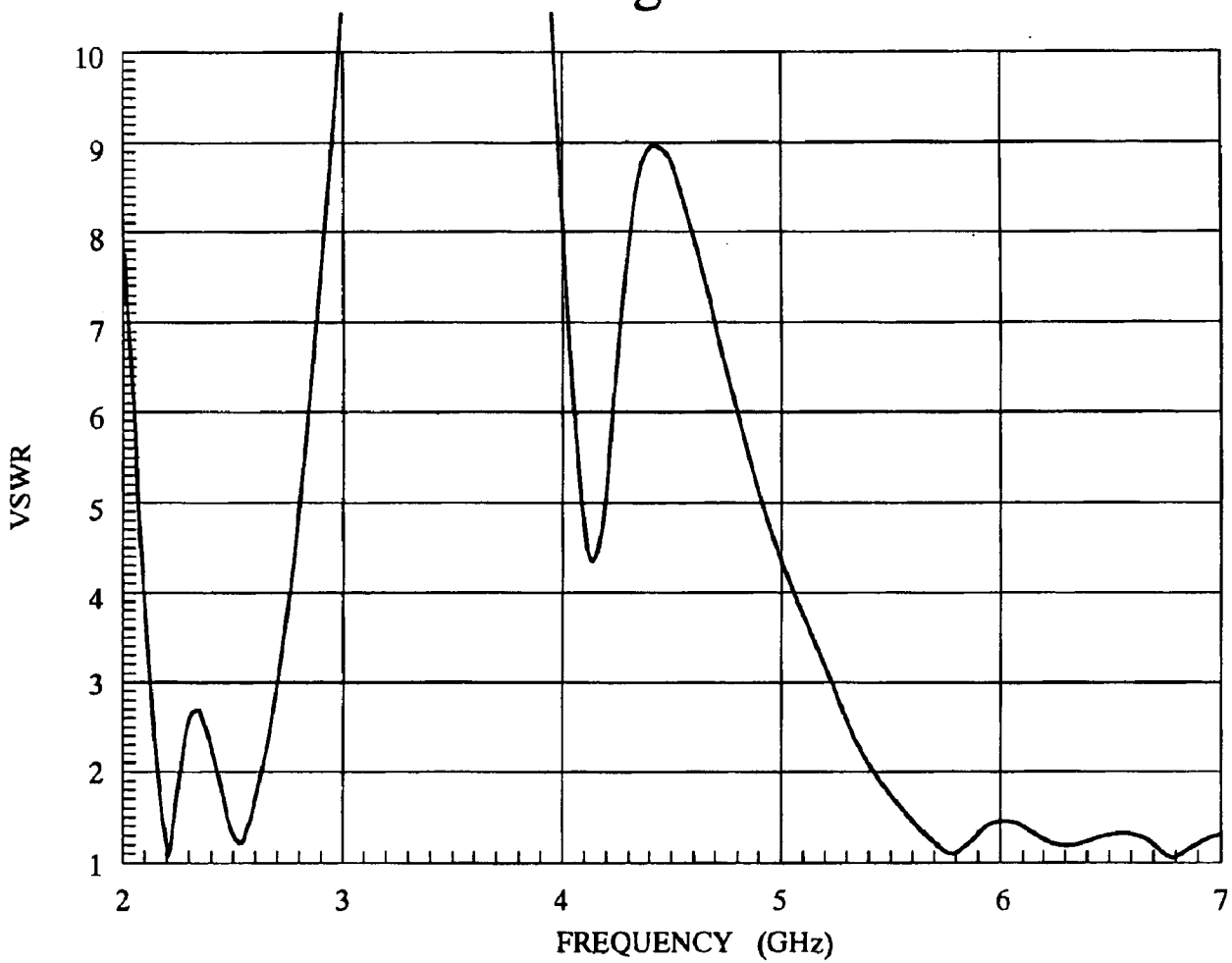
FIG. 25 is a diagram showing a VSWR characteristic in the fourth embodiment of the present invention.

The VSWR of the dielectric antenna 40 is the result of combination of the VSWRs of the individual antenna elements 43 and 44, as shown in FIG. 25. Therefore, the frequency bandwidth through which a low VSWR is exhibited is extended in comparison with the case where one of the antenna elements 43 and 44 is singly used, thereby enabling use in a wider band. In the VSWR characteristic shown in FIG. 25, small favorable VSWR values are exhibited, that is, the VSWR is 3 or less at 2.15 to 2.68 GHz, 1.1 at 2.25 GHz, and 1.4 at 2.50 GHz. Thus, in the dielectric antenna 40 of this embodiment, the bandwidth suitably usable in a used frequency band can be extended, as indicated by the characteristic curve.

Further, the VSWR is also reduced to about 3 with respect to frequencies in the 5.2 GHz band, thus making it possible to perform transmitting and receiving with no problem.

Also, the dielectric antenna 40 has a gain characteristic such as shown in FIG. 6 and the same radiant beam patterns as those shown in FIGS. 8 to 10.

Consequently, in use of the dielectric antenna 40 of this embodiment, when the dielectric antenna 40 is mounted on the circuit board 1, the distance L2 from the grounding conductor 3 formed on the circuit board 1 can be reduced in comparison that in the conventional arrangement, thus enabling great contribution to the miniaturization and integration of a cellular phone or a portable wireless communication device. Further, it is possible to perform transmitting and receiving of electric waves in each of the two frequency bands: the 2.4 GHz band and the 5.2 GHz band by using the dielectric antenna 40.

Figure 26:
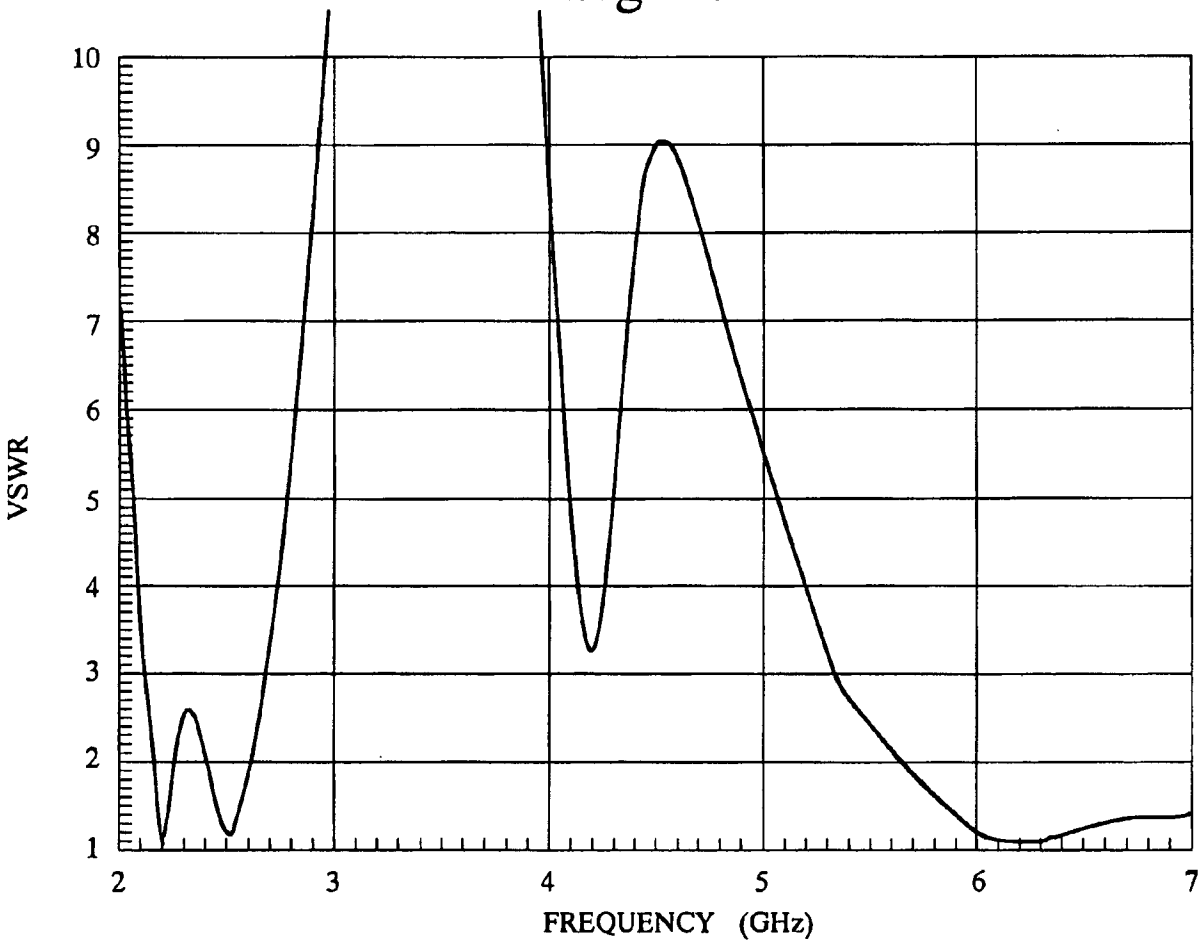
FIG. 26 is a diagram showing a VSWR characteristic in a comparative example for comparison with the fourth embodiment of the present invention.

FIG. 26 shows a comparative example. FIG. 26 is a diagram showing a VSWR characteristic of the dielectric antenna 10 of the first embodiment at 2 to 7 GHz. Thus, in the dielectric antenna 10 of the first embodiment, the VSWR in the 5.2 GHz band is equal to or higher than 5 and transmitting and receiving of electric waves in the 5.2 GHz band is almost impossible because of an excessively large loss.

As described above, the dielectric antenna 40 of the fourth embodiment can be used in two different frequency bands because the meander spacing (meander pitch) of the antenna element 43 is set as described above.

Also, in the dielectric antenna 40, the open stub 45 is provided to enable control of the impedance including the state of coupling as well as adjustment of the resonance frequency. Thus, an effect other than the effect of achieving the 6% reduction rate can also be obtained.

Also, it is possible to change the resonance frequency and the feed point impedance by changing the length Lst and the width Wst of the open stub 45 or the position at which the open stub 45 and the conductor 44*a* are connected.

It is also possible to change the resonance frequency and the feed point impedance by changing the length and area of the conductors 43*k* and 44*g* in the end portions of the antenna elements 43 and 44 and the entire length and area of the conductors 43*l* to 43*o* connecting the feed point and the grounding terminal in the antenna element 43.

As described above, the dielectric antenna in accordance with the present invention is provided with an open stub and is therefore capable of resonating at each of frequencies to be used even when the length of each of the first and second antenna elements is shorter than the ordinary length determined according to the frequency to be used. Further, in the dielectric antenna in accordance with the present invention, the frequency bandwidth through which a good VSWR characteristic can be obtained in a used frequency band can be extended even if the dielectric antenna is placed in the vicinity of a grounding conductor pattern when mounted on a circuit board. Therefore the distance from a grounding conductor formed on a circuit board can be set shorter in comparison with the conventional arrangement when the dielectric antenna is mounted on the circuit board, thus enabling great contribution to the miniaturization and integration of a cellular phone or a portable wireless communication device.

Since the dielectric antenna in accordance with the present invention can be used in two different frequency bands, it can be used in each of the 2.4 GHz band and the 5.2 GHz band used for wireless LAN. Therefore when a wireless communication device for wireless LAN capable of operating in each of the two frequency bands is configured, the need for providing antennas capable of respectively operating in the two frequency bands is eliminated, thus greatly contributing the miniaturization of wireless communication devices.

Figure 27:
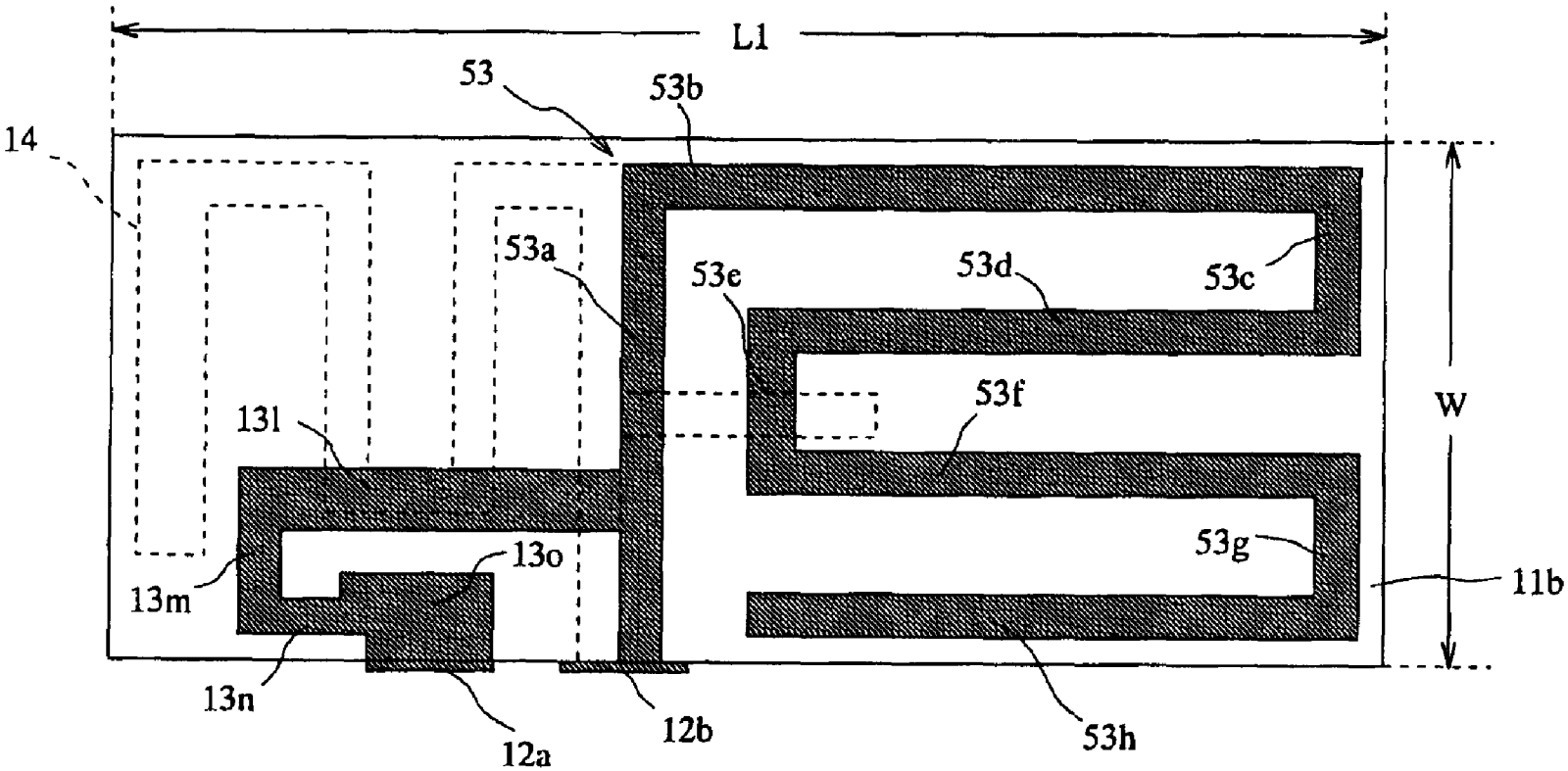
FIG. 27 is a plan view of another configuration of an antenna element in accordance with the present invention.

Each of the above-described first to third embodiments is only an example of the present invention, and the present invention is not limited to the embodiments. For example, a first antenna element 13 such as shown in FIG. 27 may be provided in place of the first antenna element 53 of the first embodiment. This first antenna element 53 has conductors 53*b* to 53*h* placed by changing the meandering direction through 90° in place of the conductors 13*b* to 13*k* of the first antenna element 13. Thus, the antenna element meandering direction is not limited to that in the above-described embodiments.

Thus, the present invention can be implemented in other various forms without departing from the spirit or the main features thereof. Accordingly, the above-described embodiments are only an example in every respect and are not to be limitingly construed. The scope of the present invention is defined in the appended claims and is not restricted by the specification. Further, all modifications and changes which belong to the uniform scope defined in the appended claims fall in the scope of the present invention.

INDUSTRIAL APPLICABILITY OF THE INVENTION

A dielectric antenna 10 is formed in which a first antenna element 13 resonating at a first frequency and a second antenna element 14 resonating at a second frequency different from the first frequency are provided on a laminated member 11, and which has an external terminal 12*b* for feed connected to a feed point of the first and second antenna elements, and an open stub 15 connected to the second antenna element in the vicinity of the feed point. In the dielectric antenna 10, the open stub 15 enables to the first and second antenna elements shorter in length than ordinary ones to resonate at frequencies to be used. Further, even in the case of placement in the vicinity of a grounding conductor pattern at the time of mounting on a circuit board 1, the frequency bandwidth through which a good VSWR characteristic can be obtained in a used frequency band can be extended. Also, the meander spacing of the first antenna element is set to a predetermined value to reduce the voltage standing wave ratio in the second frequency band different from the first frequency band, thereby enabling use each of the first frequency band and the second frequency band.

What is claimed is:

1. A dielectric antenna comprising:

a laminated member having (a) conductors on its surface and (b) at least one dielectric layer;

at least one external terminal on the external surface of the laminated member;

a first antenna element including conductors on said laminated member and having a resonance frequency at a first frequency in a first frequency band;

a second antenna element having an open stub connected thereto, said second antenna element including conductors on said laminated member and having a resonance frequency at a second frequency different from the first frequency in the first frequency band, said first antenna element and said second antenna element being disposed on different layers between which the dielectric layer is interposed, and said open stub overlapping part of the first antenna element between which the dielectric layer is interposed; and at least one external terminal on the external surface of the laminated member, one of the terminals being connected to a feed point of said first antenna element and to a feed point of said second antenna element.

2. The dielectric antenna according to claim 1, wherein one end of said open stub is connected to one of the conductors of said second antenna element connected to said external feed terminal, and said open stub being formed along the lengthwise direction of the laminated member.

3. The dielectric antenna according to claim 1, wherein an end portion of at least one of said first antenna element and said second antenna element includes at least two branches.

4. The dielectric antenna according to claim 1, wherein an end portion of at least one of said first antenna element and said second antenna element is larger in width than the inner conductor adjacent to the end portion.

5. The dielectric antenna according to claim 1, further comprising a conductor having one end connected to said first antenna element at a predetermined position on the feed point side, and an external terminal for grounding connected to the other end of the conductor.

6. The dielectric antenna according to claim 1, wherein said first frequency is higher than said second frequency.

7. The dielectric antenna according to claim 1, wherein said first antenna element is folded and meanders in a lamination surface and has a length so it is resonant at said first frequency in said first frequency band, and the meander spacing of said first antenna element is such that the voltage standing wave ratio in a frequency in a second frequency band different from said first frequency band is lower than a predetermined value.

8. The dielectric antenna according to claim 7, wherein said second frequency band is higher than said first frequency band.

9. The dielectric antenna according to claim 1, further comprising a conductor having one end connected to said first antenna element at a predetermined position on the feed point side, and an external terminal for grounding connected to the other end of the conductor.

10. A dielectric antenna comprising:

a laminated member having (a) conductors on its surface and (b) at least one dielectric layer;

a first antenna element including conductors on said laminated member and having a resonance frequency at a first frequency in a first frequency band;

a second antenna element having an open stub connected thereto, said second antenna element including conductors on said laminated member and having a resonance frequency at a second frequency different from the first frequency in the first frequency band, said first antenna element and said second antenna element being disposed on different layers between which the dielectric layer is interposed, said first antenna element being folded so as to meander in a lamination surface, and said first antenna element and said open stub being located so that portions thereof are superposed at a plurality of positions between which the dielectric layer is interposed; and at least one external terminal on the external surface of the laminated member, one of the external terminals being connected to a feed point of said first antenna element and to a feed point of said second antenna element.

11. The dielectric antenna according to claim 10, wherein the folded conductors are adjacent and parallel to each other.

12. The dielectric antenna according to claim 10, wherein one end of said open stub is connected to one of the conductors of said second antenna element connected to said external feed terminal, and said open stub being formed along the lengthwise direction of the laminated member.

13. The dielectric antenna according to claim 10, wherein the folded conductors are adjacent and parallel to each other.

14. The dielectric antenna according to claim 10, wherein an end portion of at least one of said first antenna element and said second antenna element includes at least two branches.

15. The dielectric antenna according to claim 10, wherein an end portion of at least one of said first antenna element and said second antenna element is larger in width than the inner conductor adjacent to the end portion.

16. The dielectric antenna according to claim 10, wherein said first frequency is higher than said second frequency.

17. The dielectric antenna according to claim 10, wherein said first antenna element is folded and meanders in a lamination surface and has a length so it is resonant at said first frequency in said first frequency band, and the meander spacing of said first antenna element is such that the voltage standing wave ratio in a frequency in a second frequency band different from said first frequency band is lower than a predetermined value.

18. The dielectric antenna according to claim 17, wherein said second frequency band is higher than said first frequency band.

* * * * *